US009857770B2

(12) United States Patent
Hatanaka et al.

(10) Patent No.: US 9,857,770 B2
(45) Date of Patent: Jan. 2, 2018

(54) AIR BLOWING SYSTEM AND IMAGE FORMING APPARATUS INCLUDING SAME

(71) Applicant: Sharp Kabushiki Kaisha, Sakai, Osaka (JP)

(72) Inventors: Masatsugu Hatanaka, Sakai (JP); Kiwamu Morita, Sakai (JP); Hisashi Yamanaka, Sakai (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 15/256,813

(22) Filed: Sep. 6, 2016

(65) Prior Publication Data

US 2016/0370760 A1 Dec. 22, 2016

Related U.S. Application Data

(63) Continuation of application No. 14/700,239, filed on Apr. 30, 2015, now Pat. No. 9,465,359.

(30) Foreign Application Priority Data

Jul. 2, 2014 (JP) ..... 2014-137104
Jul. 2, 2014 (JP) ..... 2014-137105

(51) Int. Cl.
*G03G 21/20* (2006.01)

(52) U.S. Cl.
CPC ..... *G03G 21/206* (2013.01)

(58) Field of Classification Search
USPC ..... 399/45, 91–94, 97, 98
See application file for complete search history.

(56) References Cited

U.S. PATENT DOCUMENTS 8,320,786 B2 * 11/2012 Kajiwara ..... G03G 21/206 250/423 R
8,391,741 B2 * 3/2013 Fujii ..... G03G 15/5004 399/43
8,639,149 B2 * 1/2014 Tanaka ..... B41J 29/13 399/93

OTHER PUBLICATIONS

Hatanaka et al., "Air Blowing System and Image Forming Apparatus Including Same", U.S. Appl. No. 14/700,239, filed Apr. 30, 2015.

* cited by examiner

*Primary Examiner* — Hoan Tran
(74) *Attorney, Agent, or Firm* — Keating & Bennett, LLP

(57) ABSTRACT

Disclosed is an air blowing system including: an air blowing device; a duct that guides air blown by the air blowing device; and a ventilation section disposed downstream of the duct in terms of an air blowing direction in which air is blown by the air blowing device so that the air blown by the air blowing device strikes and passes through the ventilation section, wherein the duct has a distorted portion where a part of an inner wall face of the duct located between the air blowing device and the ventilation section is distorted perpendicular or substantially perpendicular to the air blowing direction so that the air blown by the air blowing device flows perpendicularly or substantially perpendicularly to the air blowing direction. Also disclosed is an air blowing system including: an air blowing device; and a duct that guides air blown by the air blowing device, wherein the duct has an outer surface on at least a part of which there is provided a surface area reducing portion for reducing a surface area of a continuous face.

7 Claims, 21 Drawing Sheets

AIR BLOWING SYSTEM AND IMAGE FORMING APPARATUS INCLUDING SAME

CROSS-REFERENCE TO RELATED APPLICATIONS

The present application hereby claims priority under 35 U.S.C. §119(a) on Japanese Patent Applications, Tokugan, Nos. 2014-137104 and 2014-137105 (both filed Jul. 2, 2014 in Japan), the entire contents of which are hereby incorporated herein by reference.

BACKGROUND OF INVENTION

The present invention relates in general to an air blowing system including an air blowing device and a duct that guides air blown by the air blowing device and relates in particular to an air blowing system included in a copying machine, a multi-function device, a printer, or any other like image forming apparatus that forms an image on a recording sheet, for example, by an electrophotographic image forming method.

Air blowing systems including an air blowing device and a duct that guides air blown by the air blowing device have disadvantages related to unwanted noise produced by the air flow as detailed below.

For example, a ventilation section is disposed downstream of a duct in terms of a direction in which air is blown by the air blowing device ("air blowing direction") so that the air blown by the air blowing device strikes and passes through the ventilation section. Specifically, an image forming apparatus including such an air blowing system typically vents air out of the image forming apparatus by guiding the air from the air blowing device through the duct and the ventilation section of the image forming apparatus. A specific example of the ventilation section is an opening section with an opening being formed through an exterior member of the image forming apparatus (e.g., an opening section with a plurality of slits). Another example is a filter (e.g., a purification filter that removes dust, toner, and other fine particles or an ozone filter that removes ozone).

The air blown by the air blowing device, when it passes through the ventilation section in the air blowing system, produces an unpleasant whistling sound, disturbing the user.

In the same type of air blowing system with an air blowing device and a duct, the air blown by the air blowing device causes the duct to bend periodically (vibrate) when the air passes through the duct. The vibration in turn causes resonance and produces an unpleasant resonating sound, disturbing the user.

In relation to these problems, Japanese Patent Application Publication, Tokukai, No. 2001-166622 discloses a duct extending from a single air blowing port and forking into two branch air paths. The two air paths of the duct are separated from each other by ribs.

The duct and ribs of Japanese Patent Application Publication, Tokukai, No. 2001-166622, however, are not sufficiently capable of reducing the whistling sound produced when the air blown by the air blowing device passes through the ventilation section, because the air paths are separated simply by ribs.

The simple separation of air paths by ribs of Japanese Patent Application Publication, Tokukai, No. 2001-166622 is also not sufficiently capable of reducing the resonating sound produced by the resonance of the duct that bends periodically (vibrates) when the air blown by the air blowing device passes through the duct.

Accordingly, the present invention has an object to provide an air blowing system and an image forming apparatus including the air blowing system. This air blowing system includes an air blowing device and a duct that guides air blown by the air blowing device. The air blowing system is also capable of reducing unwanted noise produced by the air flow (specifically, the whistling sound produced when the air blown by the air blowing device passes through the ventilation section and the resonating sound produced by the resonance of the duct that bends periodically (vibrates) when the air blown by the air blowing device passes through the duct).

SUMMARY OF INVENTION

The inventors of the present invention have found that in an air blowing system including: an air blowing device; a duct that guides air blown by the air blowing device; and a ventilation section disposed downstream of the duct in terms of an air blowing direction in which air is blown by the air blowing device so that the air blown by the air blowing device strikes and passes through the ventilation section, the whistling sound produced by the ventilation section can be reduced by varying the air flow inside the duct so as to alter the angle at which the air blown by the air blowing device strikes the ventilation section ("striking angle").

The present invention, conceived based on this finding, provides an air blowing system of a first aspect and an image forming apparatus of a first aspect as detailed below to address the problems.

1. First Aspect of Air Blowing System

An air blowing system of the first aspect in accordance with the present invention includes: an air blowing device; a duct that guides air blown by the air blowing device; and a ventilation section disposed downstream of the duct in terms of an air blowing direction in which air is blown by the air blowing device so that the air blown by the air blowing device strikes and passes through the ventilation section, wherein the duct has a distorted portion where a part of an inner wall face of the duct located between the air blowing device and the ventilation section is distorted perpendicular or substantially perpendicular to the air blowing direction so that the air blown by the air blowing device flows perpendicularly or substantially perpendicularly to the air blowing direction.

2. First Aspect of Image Forming Apparatus

An image forming apparatus of the first aspect in accordance with the present invention includes the air blowing system of the first aspect in accordance with the present invention.

In the first aspect, the distorted portion may be a concave distortion where that part of the inner wall face is distorted in a concave shape.

In the first aspect, the duct may have a linear portion between the air blowing device and the ventilation section; and the distorted portion may be provided in the linear portion.

The present invention is preferably used if, in the first aspect, the ventilation section is a filter and/or an opening section that has an opening, formed through an exterior member of an image forming apparatus, through which air is vented out of the image forming apparatus.

In the first aspect, the ventilation section may have an air entering face where the air blown by the air blowing device enters the ventilation section; and the duct and the air blowing device may be arranged so that the air blowing direction inclines, relative to the air entering face of the ventilation section, in a non-distorting direction different from a distorting direction in which that part of the inner wall face is distorted to form the distorted portion.

In the first aspect, the duct may have an inner surface on which there is provided a rib that deflects the air blown by the air blowing device in an intersecting direction that is a non-distorting direction different from a distorting direction in which that part of the inner wall face is distorted to form the distorted portion and that intersects the air blowing direction.

The inventors of the present invention have found that in an air blowing system including: an air blowing device; and a duct that guides air blown by the air blowing device, the periodical bending of the duct that occurs when the air blown by the air blowing device passes through the duct can be reduced progressively with a reduction in the surface area of the continuous face on the surface of the duct, and the reduced periodical bending of the duct can efficiently prevent the vibration of the duct and the resonance of the duct that could be caused by the vibration.

The present invention, conceived based on this finding, provides an air blowing system of a second aspect and an image forming apparatus of a second aspect as detailed below to address the problems.

3. Second Aspect of Air Blowing System

An air blowing system of the second aspect in accordance with the present invention includes: an air blowing device; and a duct that guides air blown by the air blowing device, wherein the duct has an outer surface on at least a part of which there is provided a surface area reducing portion for reducing a surface area of a continuous face.

4. Second Aspect of Image Forming Apparatus

An image forming apparatus of the second aspect in accordance with the present invention includes the air blowing system of the second aspect in accordance with the present invention.

In the second aspect, the duct may have an intersecting duct portion in a direction that intersects an air blowing direction in which air is blown by the air blowing device; and the surface area reducing portion may be provided at least on the intersecting duct portion of the outer surface of the duct.

In the second aspect, the surface area reducing portion may be formed in a convex shape integrally with at least a part of the outer surface of the duct.

In the second aspect, the surface area reducing portion may be a demarcating portion that demarcates at least a part of the outer surface of the duct.

In the second aspect, the surface area reducing portion may have a latticed part.

In the second aspect, air blowing system may further include a ventilation section disposed downstream of the duct in terms of an air blowing direction in which air is blown by the air blowing device so that the air blown by the air blowing device strikes and passes through the ventilation section, wherein: the ventilation section has an air entering face where the air blown by the air blowing device enters the ventilation section; and the duct and the air blowing device are arranged so that the air blowing direction inclines relative to the air entering face of the ventilation section.

In the second aspect, the duct may have an inner surface on which there is provided a rib that deflects the air blown by the air blowing device in a deflecting direction different from the air blowing direction.

The present invention can reduce unwanted noise during air blowing (specifically, a whistling sound produced when the air blown by the air blowing device passes through the ventilation section and a resonating sound produced by the duct bending periodically (vibrating), and hence resonating, when the air blown by the air blowing device passes through the duct).

DESCRIPTION OF EMBODIMENTS

The following will describe embodiments in accordance with the present invention in reference to drawings.

Overall Structure of Image Forming Apparatus

Figure 1:
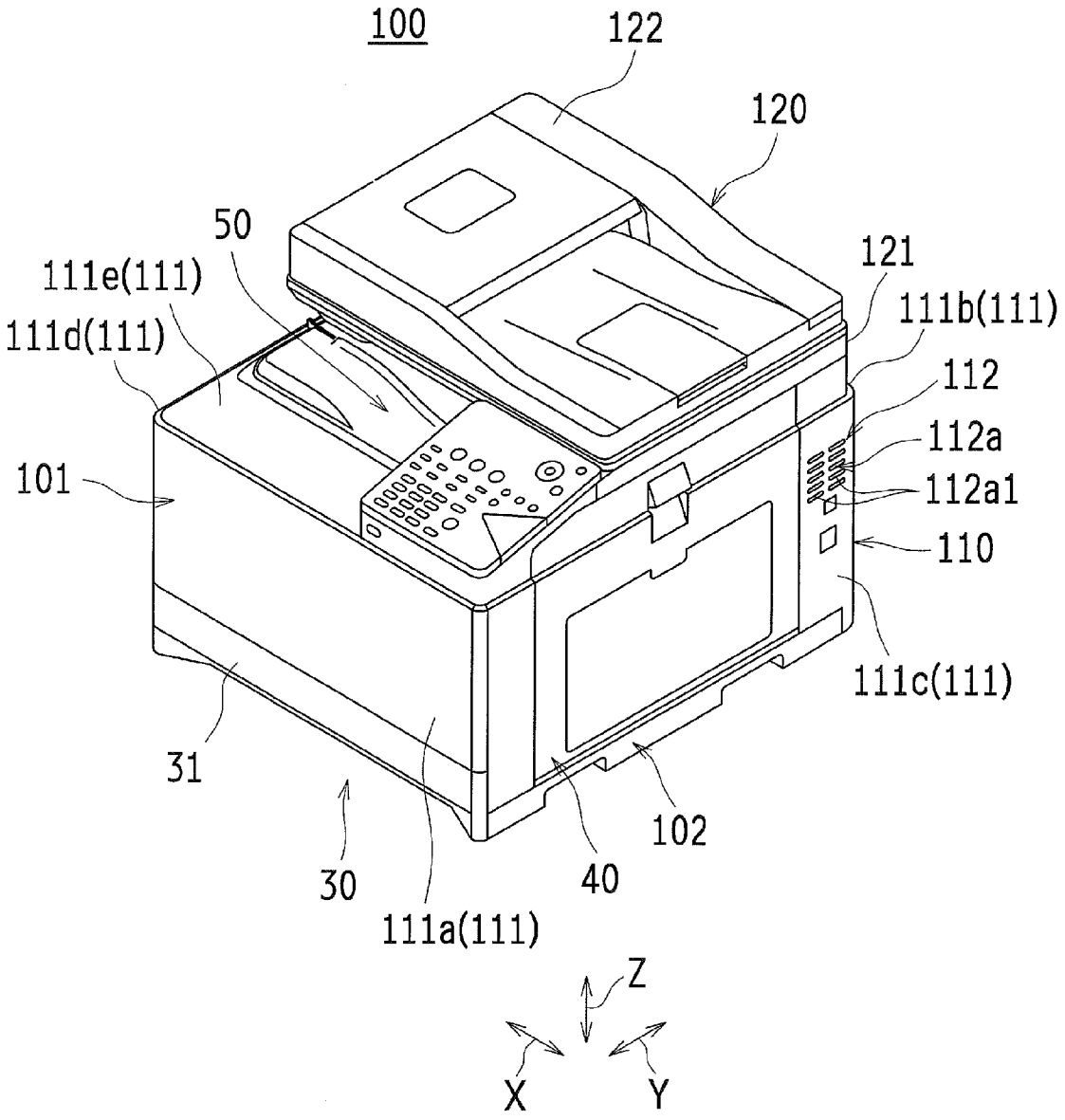
FIG. 1 is an oblique view of the appearance of an image forming apparatus in accordance with the present embodiment.
Figure 2:
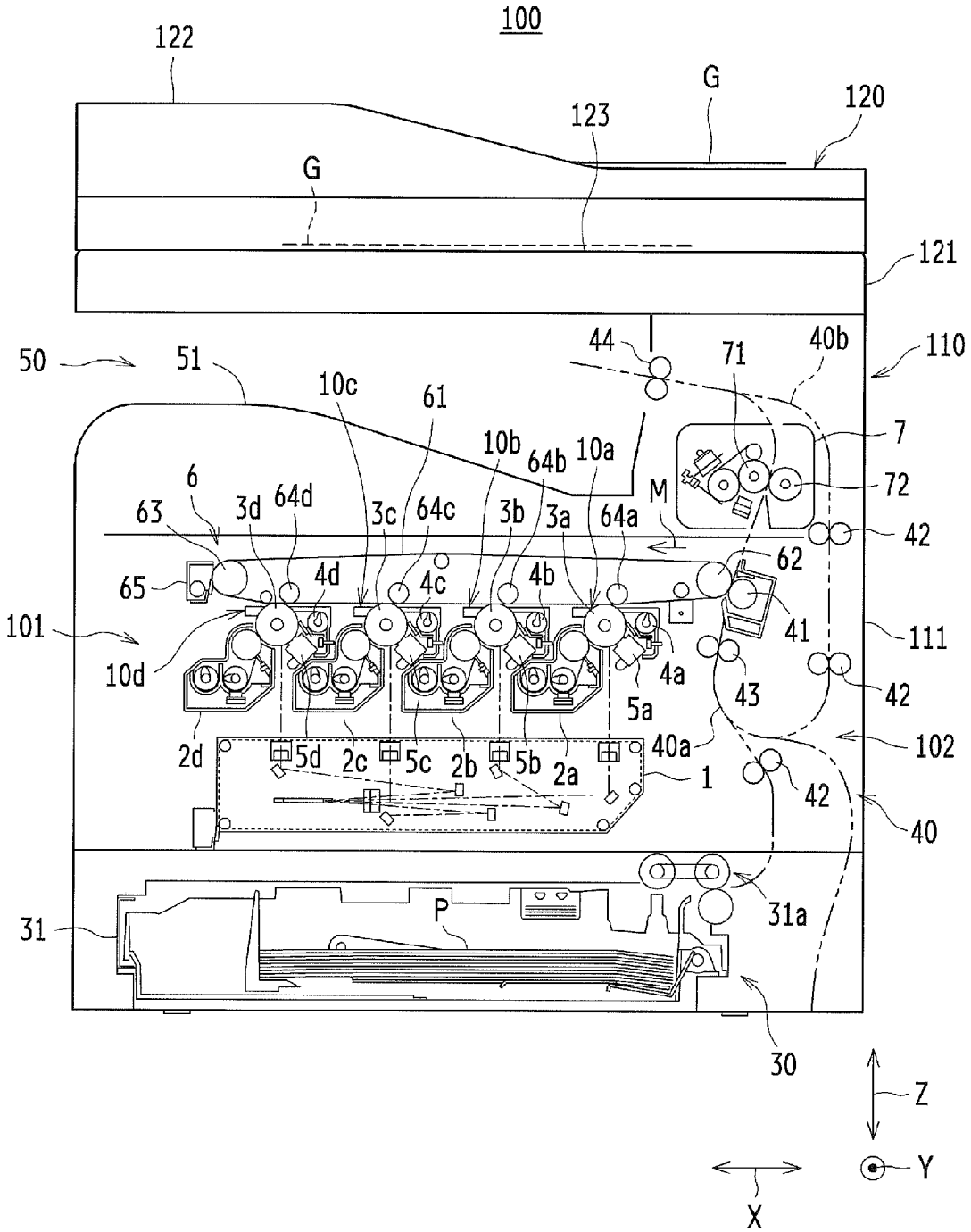
FIG. 2 is a schematic cross-sectional view of the image forming apparatus shown in FIG. 1 as viewed from the front.

FIG. 1 is an oblique view of the appearance of an image forming apparatus 100 in accordance with the present embodiment. FIG. 2 is a schematic cross-sectional view of the image forming apparatus 100 shown in FIG. 1 as viewed from the front.

The image forming apparatus 100, shown in FIGS. 1 and 2, contains a plurality (four in this example) of image carriers (specifically, photosensitive drums 3*a* to 3*d*) disposed parallel to each other in a predetermined direction (in width direction X in this example; see FIG. 2). The image forming apparatus 100 is a tandem-type color image forming apparatus that forms a multicolor or single color image on a recording sheet P, for example of paper, (see FIG. 2) from externally supplied image data. The image forming apparatus 100 includes an image forming apparatus main body 110 and an image scanning device 120. The image forming apparatus main body 110 includes an image forming unit 101 and a sheet transport system 102. Width direction X corresponds to the left and right direction when the object is viewed from the front.

The image forming unit 101 (see FIG. 2) includes an exposing apparatus 1, a plurality of development apparatuses 2*a* to 2*d*, a plurality of photosensitive body units 10*a* to 10*d*, an intermediate transfer belt apparatus 6, and a fixing apparatus 7. Each photosensitive body unit 10*a* to 10*d* contains a photosensitive drum 3*a* to 3*d*, a charging unit 5*a* to 5*d*, and a drum cleaning section 4*a* to 4*d*, structured as a single unit.

The sheet transport system 102 includes a sheet supply section 30, a sheet transport section 40, and a sheet discharge section 50.

The image forming apparatus main body 110 includes exterior members (specifically, exterior covers) 111 to cover internal structural members of the image forming apparatus main body 110. The exterior members 111 (see FIG. 1) include, to cover internal structural members of the image forming apparatus main body 110, a front side exterior member 111*a* that covers its front side, a rear side exterior member 111*b* that covers its rear side, a right side exterior member 111*c* that covers its right side, a left side exterior member 111*d* that covers its left side, and a top side exterior member 111*e* that covers its top side.

In the present embodiment, the photosensitive body units 10*a* to 10*d* and the development apparatuses 2*a* to 2*d* can be manually inserted and removed through the front of the image forming apparatus main body 110.

The image scanning device 120 is disposed on the image forming apparatus main body 110. The image scanning device 120 includes an image scanning section 121 that scans an original document G (see FIG. 2), an original document transport section 122 that transports the original document G, and an original document platen 123 (see FIG. 2) on which the original document G is placed.

In the image scanning device 120, the image scanning section 121 scans an original document G either transported by the original document transport section 122 or placed on the original document platen 123. By scanning the original document G, the image scanning device 120 generates image data that represents the scanned image and sends the image data to the image forming apparatus main body 110 where an image is reproduced from the image data and recorded on a recording sheet P.

The image forming apparatus 100 is capable of processing image data that represents a color image of a plurality of colors (here, black, cyan, magenta, and yellow). Accordingly, the plural development apparatuses 2*a* to 2*d* (here, four of them, one for each color of black, cyan, magenta, and yellow) and the plural photosensitive body units 10*a* to 10*d* (here, four of them, one for each color of black, cyan, magenta, and yellow) are provided so that plural types (here, four types) of images can be reproduced in accordance with the four colors. The development apparatuses 2*a* to 2*d* and the photosensitive body units 10*a* to 10*d* constitute a plurality of image stations (here, four of them).

The photosensitive drums 3*a* to 3*d* are disposed so that their drum shafts extend parallel to depth direction Y. The development apparatuses 2*a* to 2*d* are disposed so that development roller shafts extend parallel to depth direction Y. Depth direction Y is a direction perpendicular to both width direction X and vertical direction Z.

The intermediate transfer belt apparatus 6 (see FIG. 2) is disposed above the photosensitive drums 3*a* to 3*d*. The intermediate transfer belt apparatus 6 includes an intermediate transfer belt 61 (serving as an intermediate transfer body), an intermediate transfer belt drive roller 62, an intermediate transfer belt idler roller 63, a plurality of intermediate transfer rollers 64*a* to 64*d*, and an intermediate transfer belt cleaning apparatus 65.

Four intermediate transfer rollers 64*a* to 64*d* are provided, one for each of black, cyan, magenta, and yellow colors. The intermediate transfer belt drive roller 62 supports and stretches the endless intermediate transfer belt 61 in conjunction with the intermediate transfer belt idler roller 63 and the intermediate transfer rollers 64*a* to 64*d*. As the intermediate transfer belt drive roller 62 is driven to rotate, the intermediate transfer belt 61 orbits in predetermined movement direction M (see FIG. 2), which in turn drives the intermediate transfer belt idler roller 63 and the intermediate transfer rollers 64*a* to 64*d* to rotate.

The image forming apparatus main body 110, in order to form an image, rotates the intermediate transfer belt 61 in movement direction M and simultaneously rotates the photosensitive drums 3*a* to 3*d*, uniformly charges the surfaces of the photosensitive drums 3*a* to 3*d* by the charging units 5*a* to 5*d* to a predetermined electric potential, exposes the surfaces of the photosensitive drums 3*a* to 3*d* to laser beams from the exposing apparatus 1 that correspond to the toner images of the respective colors to form electrostatic latent images on the surfaces, and develops the electrostatic latent images on the surfaces of the photosensitive drums 3*a* to 3*d* by the development apparatuses 2*a* to 2*d* to form toner images on the surfaces of the photosensitive drums 3*a* to 3*d*. Toner images of a plurality of colors (four colors in this example) are formed in this manner on the respective surfaces of the photosensitive drums 3*a* to 3*d*. Thereafter, residual toner on the surfaces of the photosensitive drums 3*a* to 3*d* is removed and collected by the drum cleaning sections 4*a* to 4*d*.

Subsequently, in the intermediate transfer belt apparatus 6, as the intermediate transfer belt 61 is rotated in movement direction M, the toner images of different colors formed on the surfaces of the photosensitive drums 3*a* to 3*d* are sequentially transferred and superimposed onto the intermediate transfer belt 61 by the intermediate transfer rollers 64*a* to 64*d* to which a transfer bias is being applied to form a color toner image on the intermediate transfer belt 61. A color toner image is formed in this manner on the surface of the intermediate transfer belt 61. Thereafter, residual toner on the surface of the intermediate transfer belt 61 is removed and collected by the intermediate transfer belt cleaning apparatus 65. The image forming apparatus 100 is arranged so that the residual toner removed and collected by the drum cleaning sections 4*a* to 4*d* and the intermediate transfer belt cleaning apparatus 65 can be stored in a waste toner cartridge (not shown).

In contrast, in the sheet supply section 30, a recording sheet P placed on a paper feed tray 31 is drawn from the paper feed tray 31 by sheet supply rollers 31*a* (see FIG. 2) and transported to the image forming unit 101 through a sheet transport path 40*a* (see FIG. 2) inside the sheet transport section 40.

The sheet transport path 40*a* is provided with a transfer roller 41, transport rollers 42, registration rollers 43, and discharge rollers 44. The registration rollers 43 temporarily stop the recording sheet P, align the leading edge of the recording sheet P, thereafter, start transporting the recording sheet P at an appropriate timing for the transfer of the color toner image that takes place in a transfer nip region formed between the intermediate transfer belt 61 and the transfer roller 41. In other words, the recording sheet P, having been transported from the sheet supply section 30 to the image forming unit 101 via the sheet transport path 40*a* in the sheet transport section 40, is pinched in the transfer nip region by the intermediate transfer belt 61 and the transfer roller 41 and transported further so that the color toner image formed on the surface of the intermediate transfer belt 61 can be transferred onto the recording sheet P by the transfer roller 41 to which a transfer bias is being applied.

The recording sheet P is then heated and pressurized by being pinched by a heating roller 71 and a pressurizing roller 72 in the fixing apparatus 7, so as to fix the color toner image on the recording sheet P. The recording sheet P is further transported via the discharge rollers 44 to the sheet discharge section 50 where the recording sheet P is discharged onto an output tray 51 of the sheet discharge section 50.

In addition, if the recording sheet P is to have an image formed on its back as well as on its front, the recording sheet P carrying on its front a toner image that has been fixed by the fixing apparatus 7 is transported by the discharge rollers 44 in an opposite direction toward a turn-over path 40*b* where the recording sheet P will be turned over as it passes through a turn-over path 40*b*. The recording sheet P is then directed again to the registration rollers 43. Thereafter, similarly to the case for the front of the recording sheet P, a toner image is formed and fixed on the back of the recording sheet P before the recording sheet P is discharged onto the output tray 51 of the sheet discharge section 50.

The ventilation section 112 and an opening section 112*a* of the ventilation section 112 shown in FIG. 1 will be described later.

Air Blowing System

Next, an air blowing system 200 in accordance with the present embodiment will be described in reference to FIGS. 3 to 21.

First Embodiment

Figure 3:
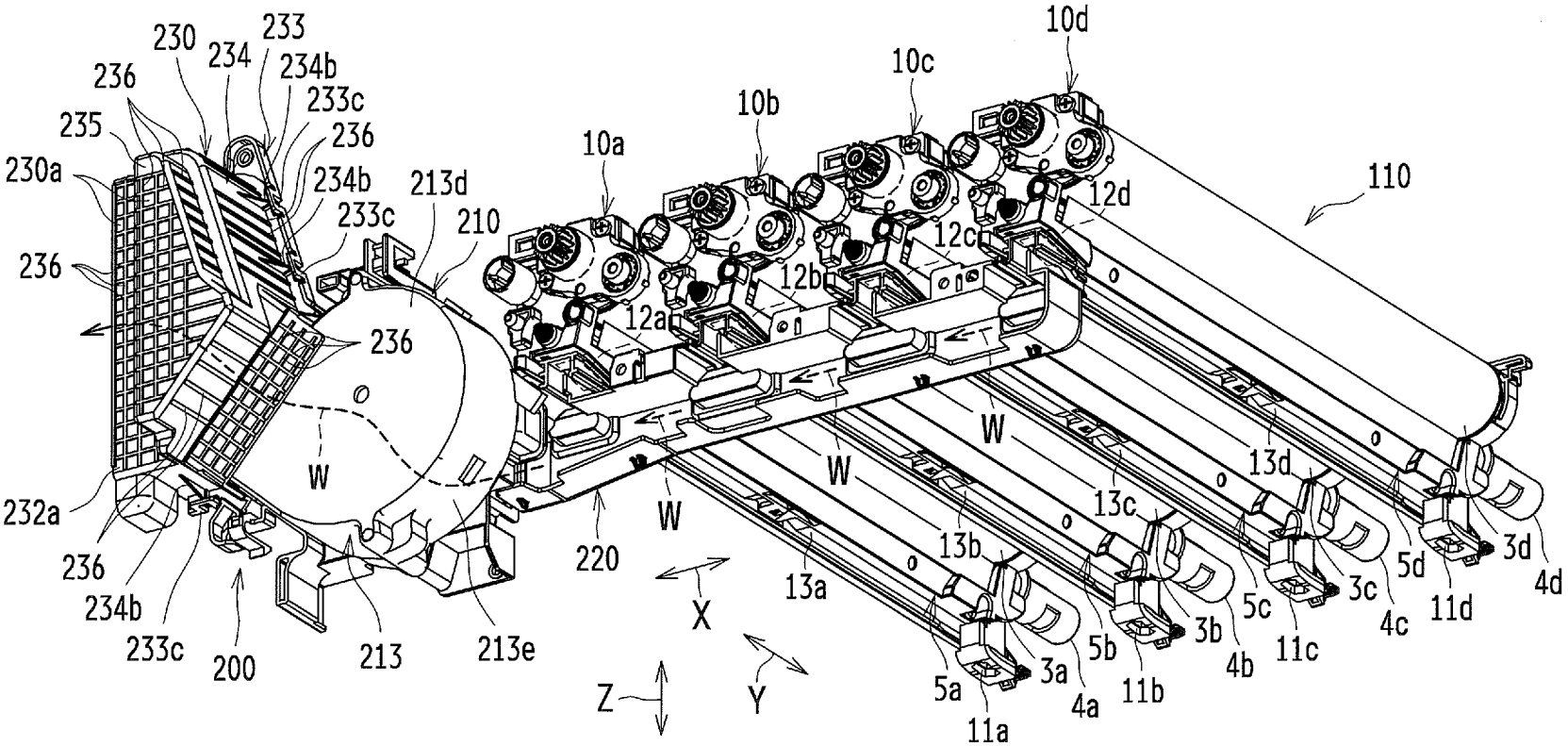
FIG. 3 is an oblique view of the rear side of an air blowing system in accordance with a first embodiment as viewed obliquely from below.
Figure 4:
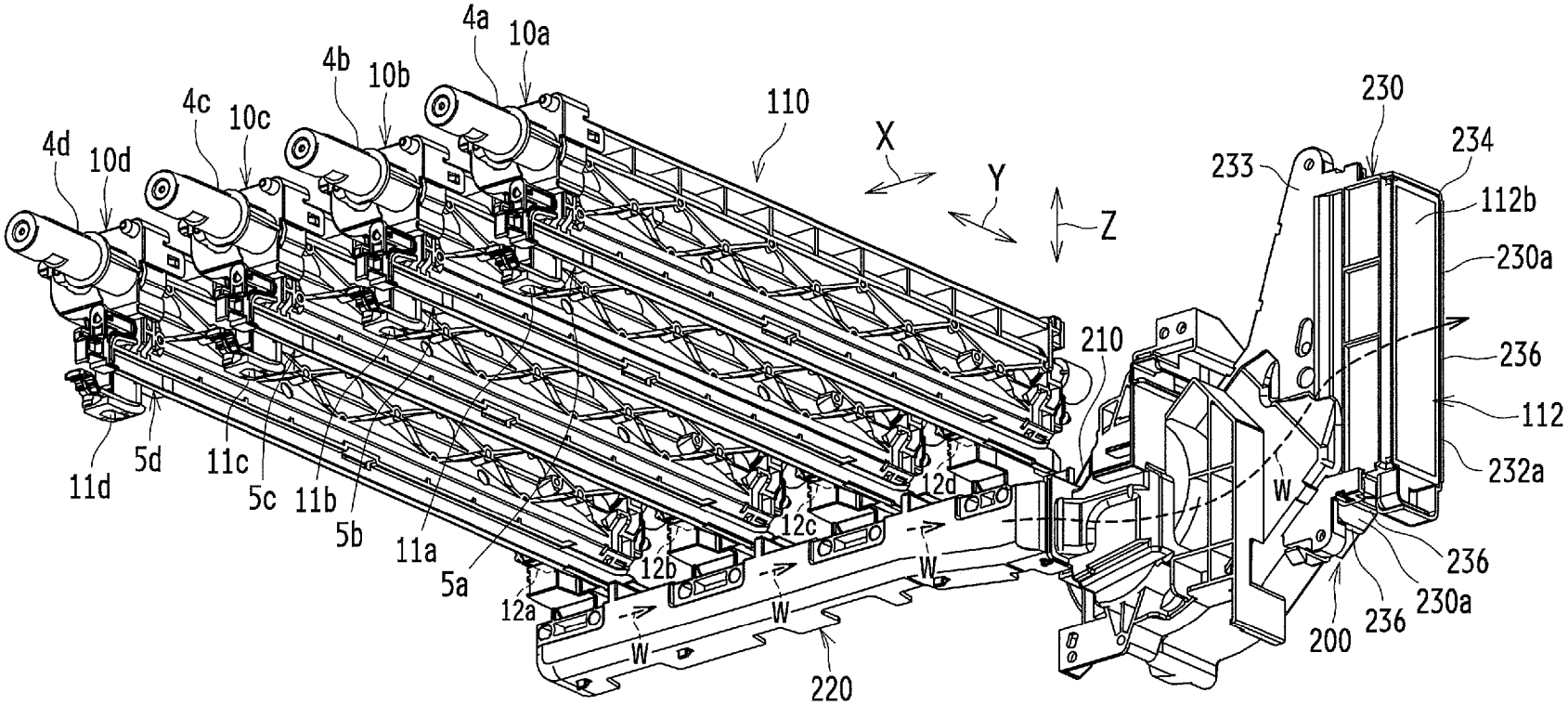
FIG. 4 is an oblique view of the front side of the air blowing system in accordance with the first embodiment as viewed obliquely from below.
Figure 5:
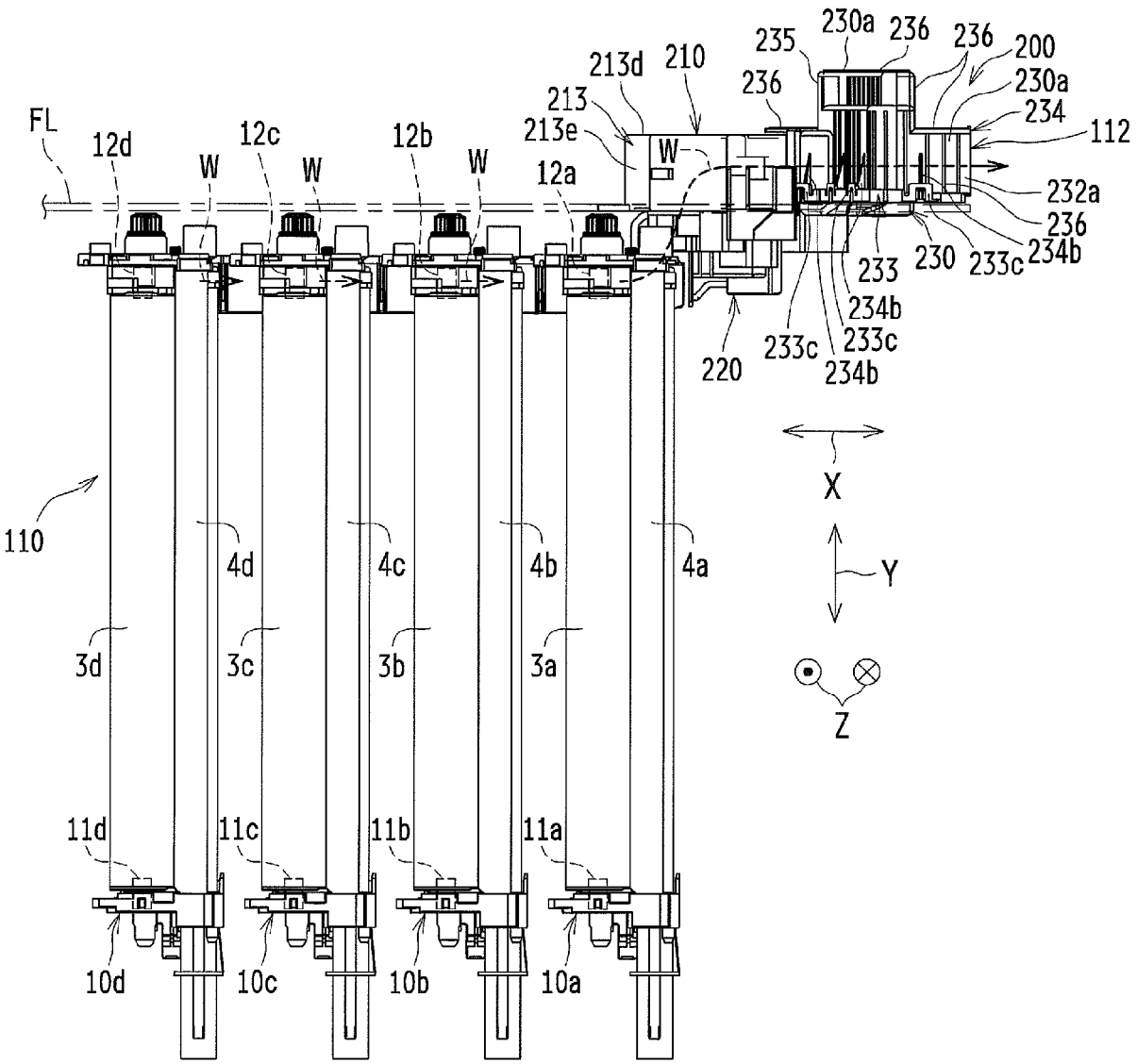
FIG. 5 is a plan view of the air blowing system in accordance with the first embodiment.
Figure 6:
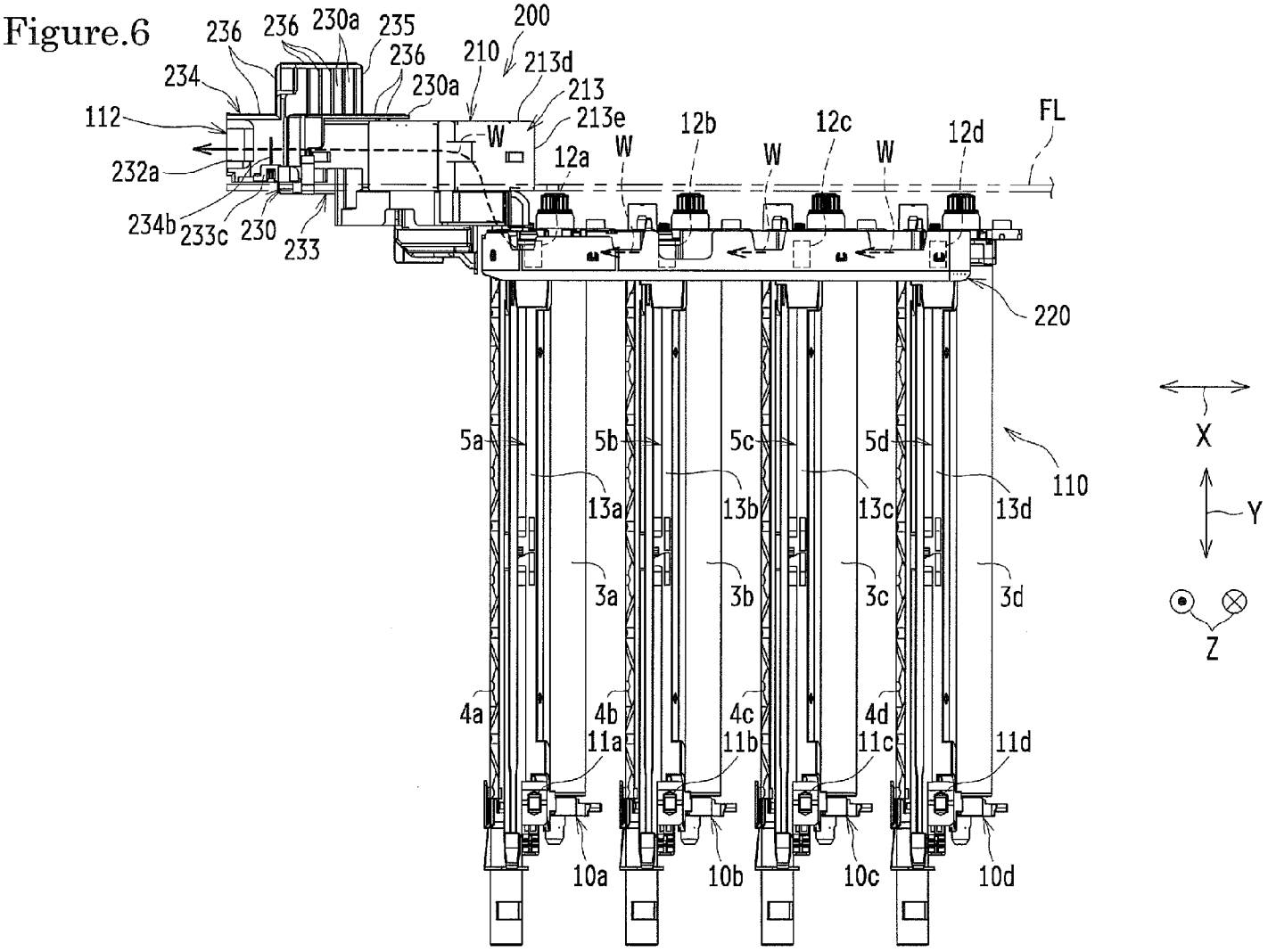
FIG. 6 is a bottom view of the air blowing system in accordance with the first embodiment.
Figure 7:
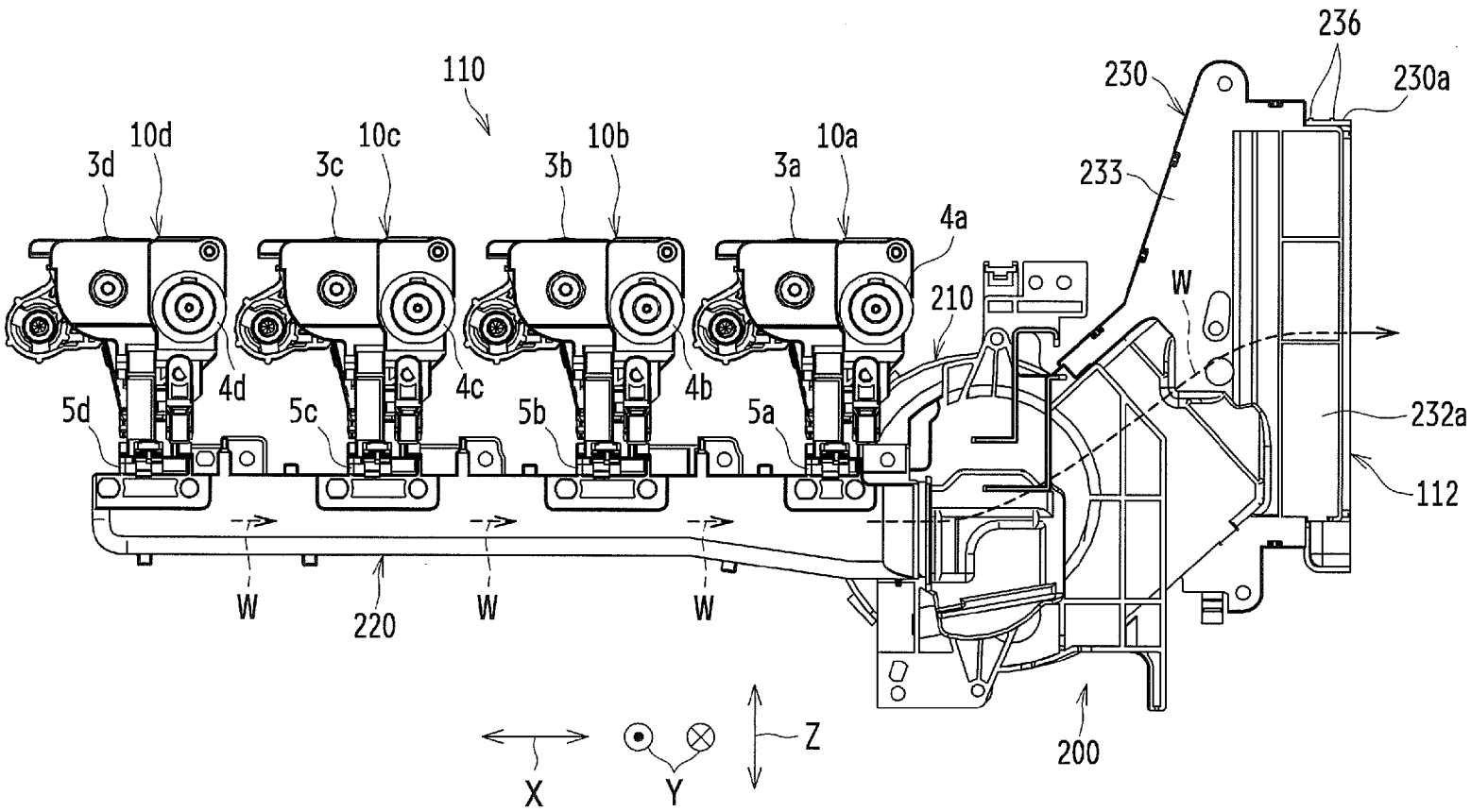
FIG. 7 is a front view of the air blowing system in accordance with the first embodiment.
Figure 8:
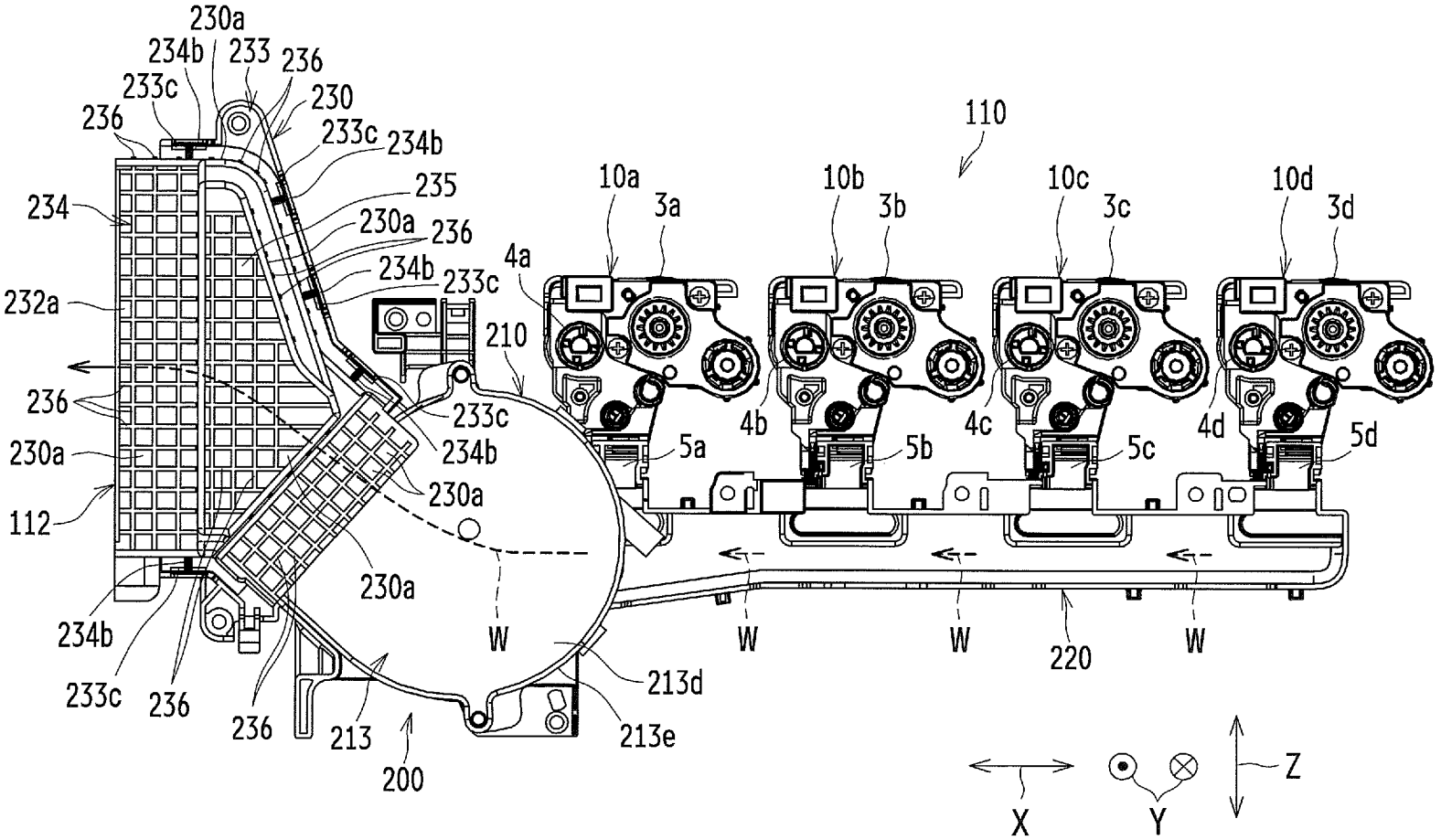
FIG. 8 is a rear view of the air blowing system in accordance with the first embodiment.
Figure 9:
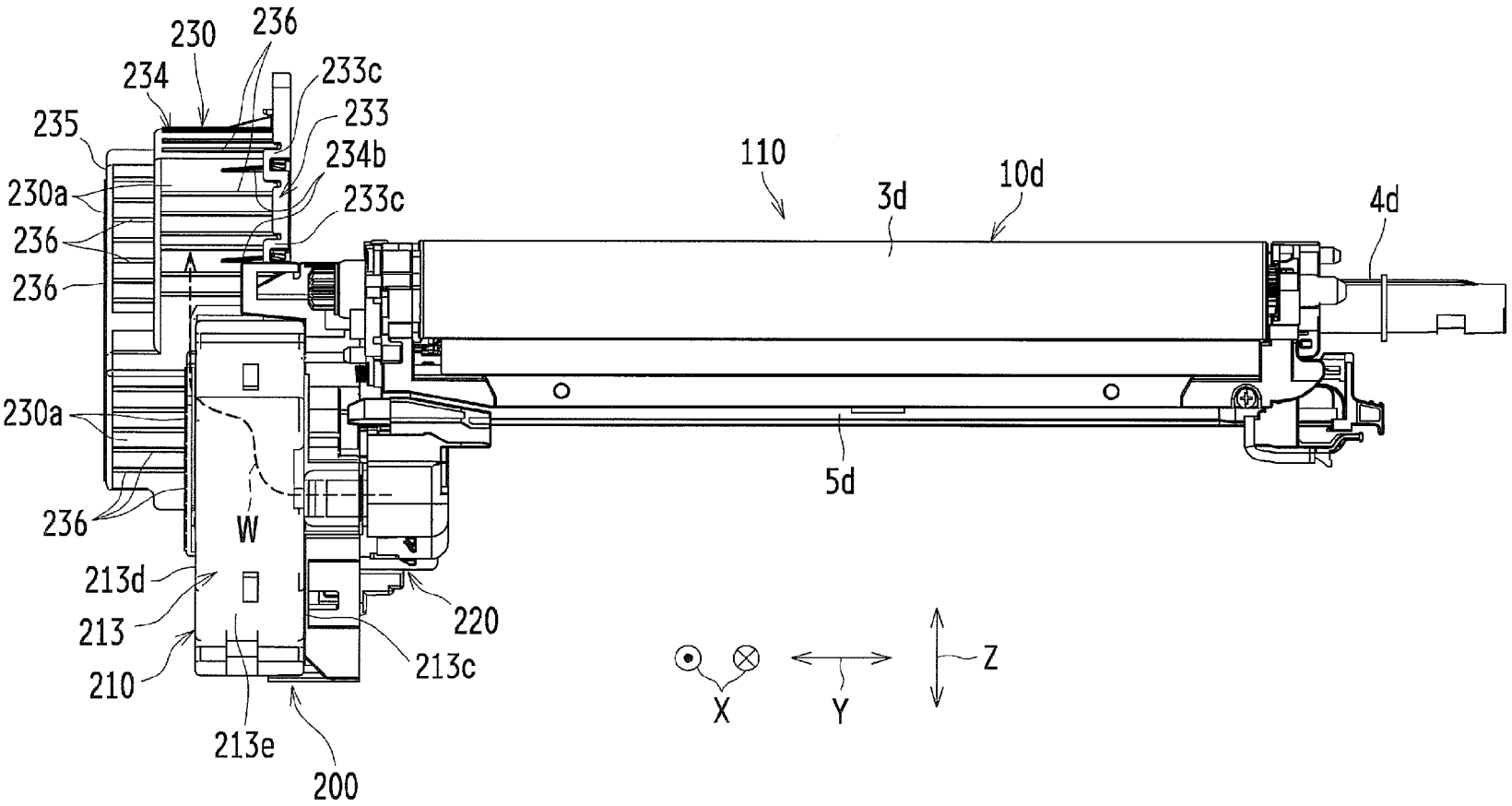
FIG. 9 is a left side view of the air blowing system in accordance with the first embodiment.
Figure 10:
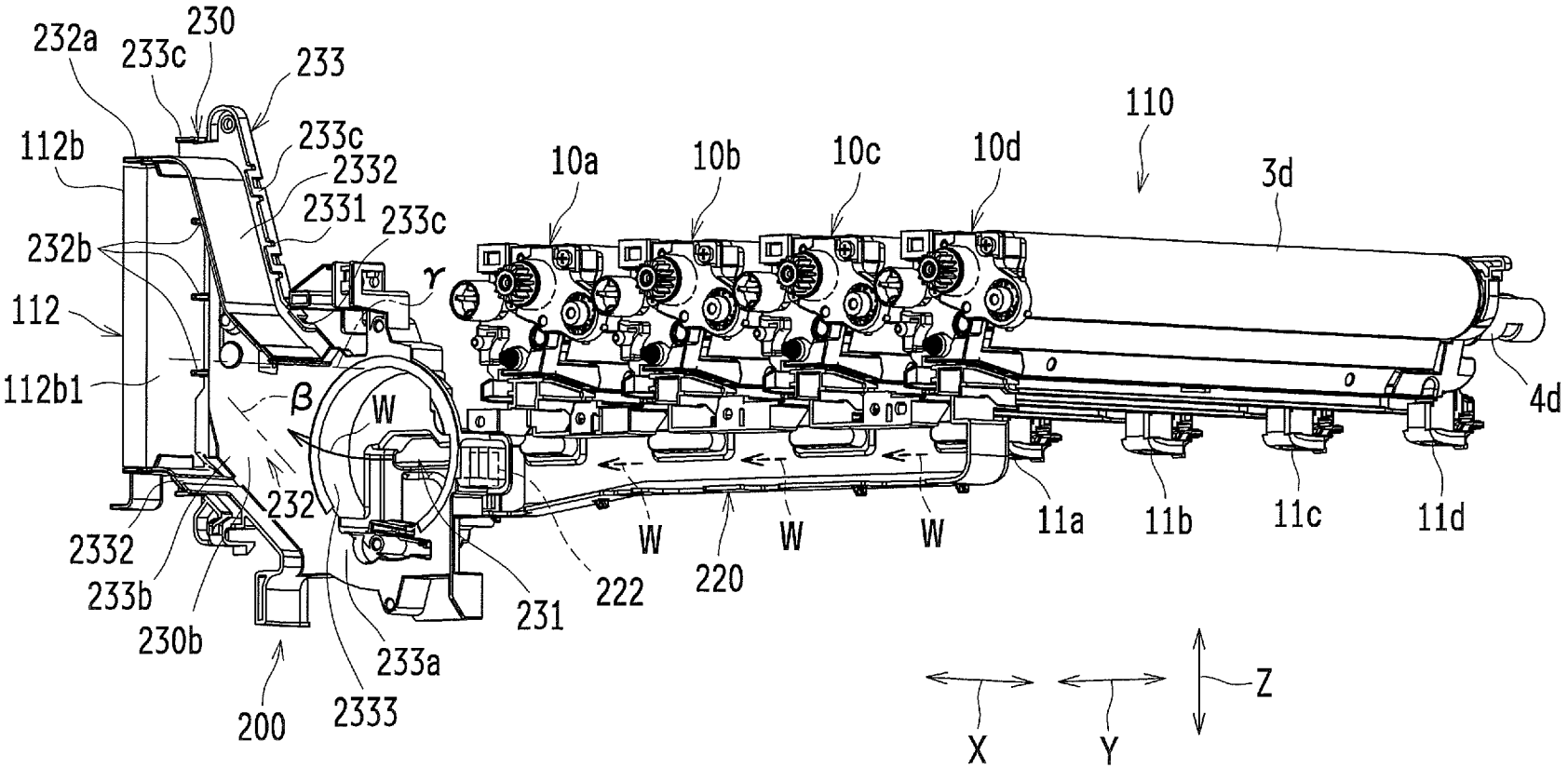
FIG. 10 is an oblique view of the rear side of the air blowing system in accordance with the first embodiment as viewed from the left, with an air blowing device and a second duct cover member for a downstream duct being removed.
Figure 11:
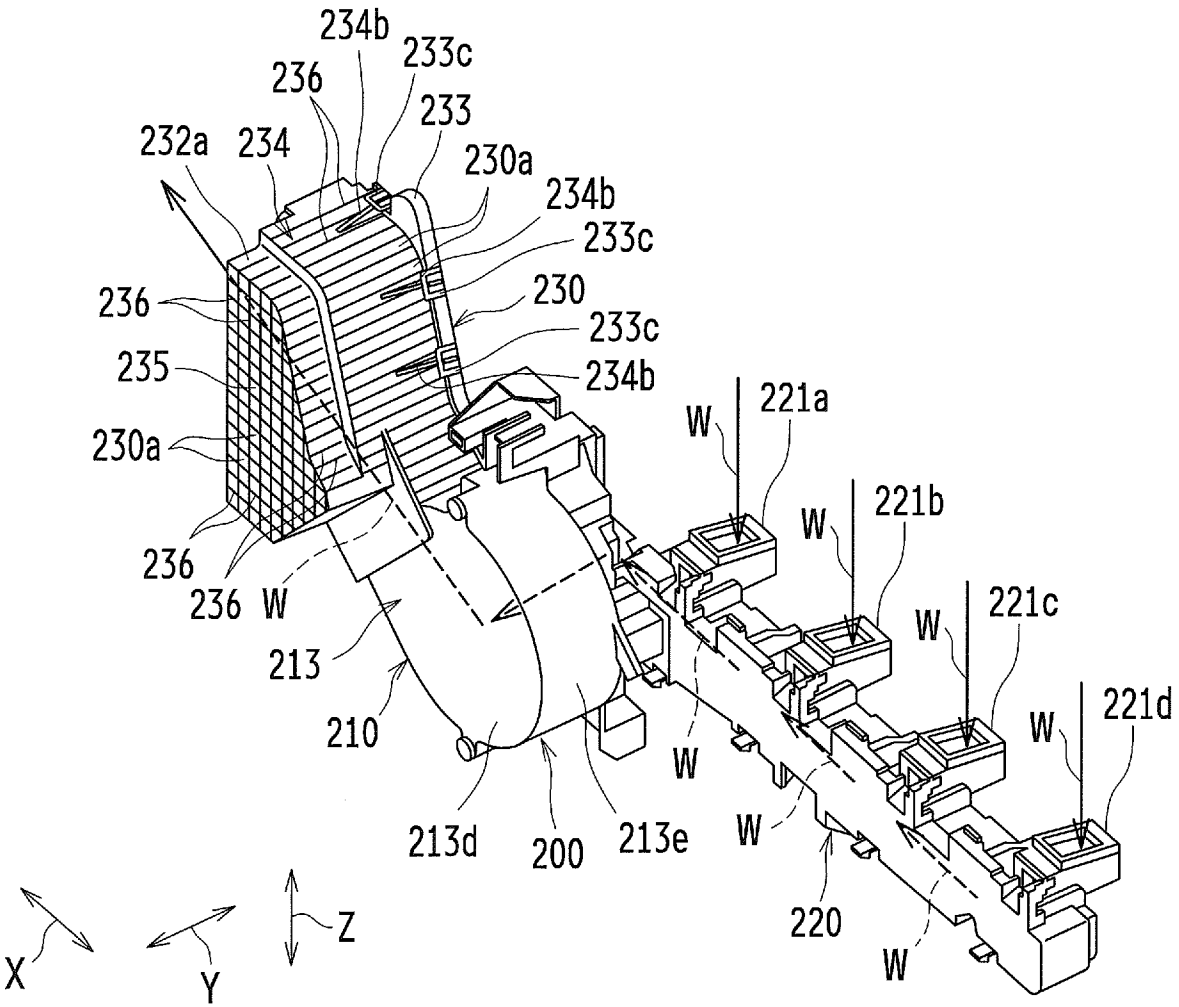
FIG. 11 is an oblique view of the rear side of the air blowing system in accordance with the first embodiment as viewed obliquely from above.
Figure 12:
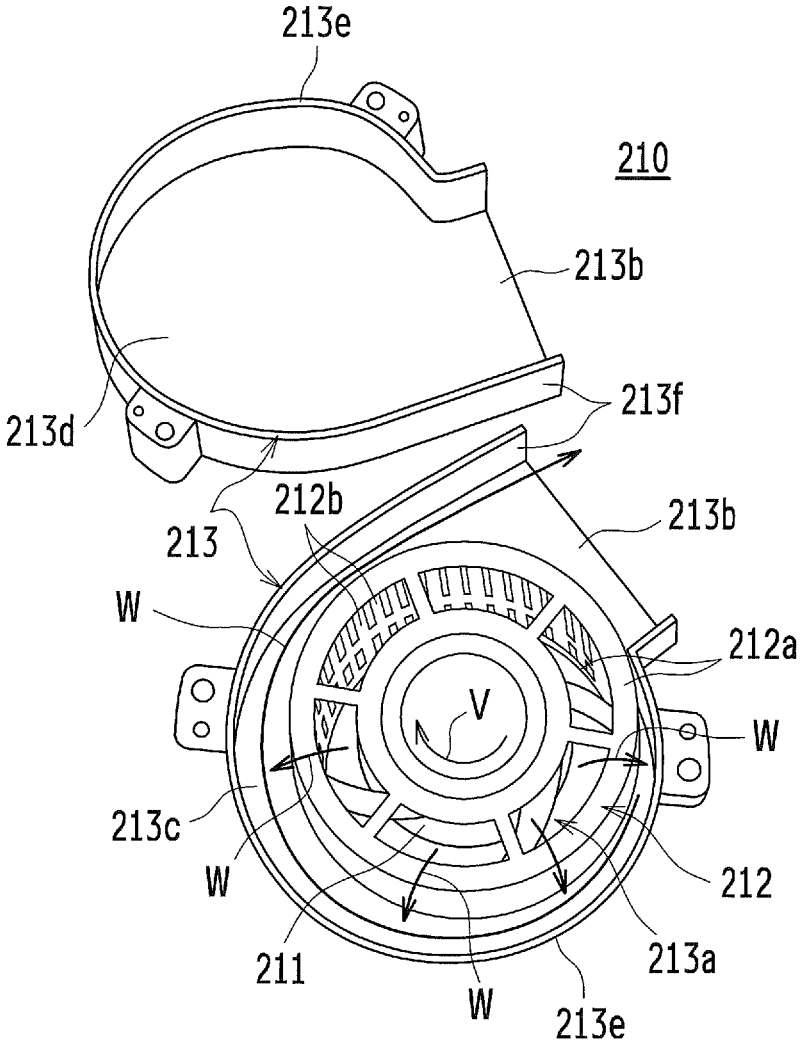
FIG. 12 is an oblique view of the internal structure of the air blowing device.

FIG. 3 is an oblique view of the rear side of the air blowing system 200 in accordance with the first embodiment as viewed obliquely from below. FIG. 4 is an oblique view of the front side of the air blowing system 200 in accordance with the first embodiment as viewed obliquely from below. FIG. 5 is a plan view of the air blowing system 200 in accordance with the first embodiment. FIG. 6 is a bottom view of the air blowing system 200 in accordance with the first embodiment. FIG. 7 is a front view of the air blowing system 200 in accordance with the first embodiment. FIG. 8 is a rear view of the air blowing system 200 in accordance with the first embodiment. FIG. 9 is a left side view of the air blowing system 200 in accordance with the first embodiment. FIG. 10 is an oblique view of the rear side of the air blowing system 200 in accordance with the first embodiment as viewed from the left, with an air blowing device 210 and a second duct cover member 234 for a downstream duct 230 being removed. FIG. 11 is an oblique view of the rear side of the air blowing system 200 in accordance with the first embodiment as viewed obliquely from above. FIG. 12 is an oblique view of the internal structure of the air blowing device 210. FIGS. 3 to 10 depict the air blowing system 200 being attached to the charging units 5*a* to 5*d* in the photosensitive body units 10*a* to 10*d*.

As illustrated in FIGS. 3 to 11, the image forming apparatus 100 includes the air blowing system 200 in accordance with the present embodiment. The air blowing system 200 is, in this example, attached to the image forming apparatus main body 110 (specifically, to the charging units 5*a* to 5*d* in the photosensitive body units 10*a* to 10*d*).

The air blowing system 200 includes the air blowing device 210 (see FIGS. 3 to 9, 11, and 12) and the downstream duct 230 (see FIGS. 3 to 11) that serves as a duct guiding the air W blown by the air blowing device 210.

The air blowing system 200 is arranged to vent air W (see FIGS. 3 to 11) out of the image forming apparatus 100 by the air blowing device 210 and the downstream duct 230. In the present embodiment, the air W contains the ozone generated by high voltage application by the charging units 5*a* to 5*d* in the photosensitive body units 10*a* to 10*d*. The air blowing system 200 moves the air W toward the outside and simultaneously removes the ozone by a filter 112*b* (see FIGS. 4 and 10) to discharge ozone-free air W to the outside.

More specifically, each charging unit 5*a* to 5*d* in the photosensitive body units 10*a* to 10*d* includes a hollow member 13*a* to 13*d* (see FIGS. 3 and 6) extending in depth direction Y. Each hollow member 13*a* to 13*d* has an opening (not shown) facing the photosensitive drum 3*a* to 3*d*. The charging units 5*a* to 5*d* each have a charging electrode (not shown) disposed in depth direction Y in the hollow member 13*a* to 13*d*, so that the surface of the photosensitive drum 3*a* to 3*d* can be charged via the opening of the hollow member 13*a* to 13*d* by the application of high voltage to the charging electrode.

The hollow members 13*a* to 13*d* each have an air inlet port 11*a* to 11*d* (see FIGS. 3 to 6 and 10) and an air outlet port 12*a* to 12*d* (see FIGS. 3 to 6). The air inlet port 11*a* to 11*d* is provided outside the stretch of the charging electrode near one of the ends (in this example, the front end) of the hollow member 13*a* to 13*d* in terms of depth direction Y. The air outlet port 12*a* to 12*d* is provided outside the stretch of the charging electrode near the other end (in this example, the rear end) of the hollow member 13*a* to 13*d* in terms of depth direction Y. The hollow members 13*a* to 13*d* are each arranged to be spatially continuous with the air inlet port 11*a* to 11*d* and the air outlet port 12*a* to 12*d*. This structure enables air W in the hollow member 13*a* to 13*d* (i.e., the air around the charging electrode) to readily flow between the air inlet ports 11*a* to 11*d* and the air outlet ports 12*a* to 12*d*.

Specifically, the hollow member 13*a* to 13*d* is structured like a box elongated in depth direction Y. The air inlet port 11*a* to 11*d* and the air outlet port 12*a* to 12*d* are provided through one of circumferential surfaces of the hollow member 13*a* to 13*d* containing air W other than the surface where the opening facing the photosensitive drum 3*a* to 3*d* is provided (in this example, through parts of the surface opposite that opening or through bottom parts of the surface).

The air blowing system 200 also includes an upstream duct 220 (see FIGS. 3 to 11). The upstream duct 220 has air inlet ports 221*a* to 221*d* (see FIG. 11) connected to the respective air outlet ports 12*a* to 12*d* of the charging units 5*a* to 5*d* and also has an air outlet port 222 (see FIG. 10) connected to an air inlet port 231 of the downstream duct 230 (see FIG. 10).

The upstream duct 220 is hollow and extends in width direction X. The air inlet ports 221*a* to 221*d* (see FIG. 11) are provided respectively at positions that correspond to the air outlet ports 12*a* to 12*d* of the charging units 5*a* to 5*d*. The air outlet port 222 (see FIG. 10) is provided outside the stretch of the charging units 5*a* to 5*d* in terms of width direction X near an end (in this example, the right end as viewed from the front) of the upstream duct 220. The air inlet ports 221*a* to 221*d* and the air outlet port 222 are hence spatially continuous. This structure enables air W in the upstream duct 220 to readily flow between the air inlet ports 221*a* to 221*d* and the air outlet port 222.

Specifically, the upstream duct 220 is structured like a box elongated in width direction X. The air inlet ports 221*a* to 221*d* are provided (see FIG. 11), next to each other in width direction X, through one of circumferential surfaces of the upstream duct 220 containing air W that faces the air outlet ports 12*a* to 12*d* of the charging units 5*a* to 5*d* (in this example, through top parts of the surface). The air outlet port 222 is provided (see FIG. 10) through one of circumferential surfaces of the upstream duct 220 containing air W that faces an inlet port 213*a* of the air blowing device 210 (in this example, through a rear part of the surface).

The air blowing device 210 (see FIG. 12) includes a drive motor 211, air blowing blades 212, and an air guiding member 213. The air blowing blades 212 are secured to the rotating shaft of the drive motor 211 to be rotated by the rotation of the rotating shaft of the drive motor 211 in predetermined direction V (clockwise as viewed from the rear). The air guiding member 213 guides air W moved by the rotation of the air blowing blades 212.

The air guiding member 213 includes the inlet port 213*a* and an ejection port 213*b*. Close to the air blowing blades 212 where the air blowing blades 212 suck in air W, the inlet port 213*a* is connected to the air inlet port 231 of the downstream duct 230 (see FIG. 10). The ejection port 213*b* is connected to a duct portion 232 of the downstream duct 230 (see FIG. 10) close to the air blowing blades 212 where the air blowing blades 212 eject air W.

Specifically, the air guiding member 213 has two flat plate portions 213*c* and 213*d* and a side plate portion 213*e* that intersects and is joined to the flat plate portions 213*c* and 213*d*. The inlet port 213*a* is opened in the flat plate portion 213*c*, one of the two flat plate portions 213*c* and 213*d*. The ejection port 213*b* is opened in a circumferential part of the side plate portion 213*e*. In the air guiding member 213, the side plate portion 213*e* has a smaller dimension (thickness) in depth direction Y (thickness direction) than do the two flat plate portions 213*c* and 213*d* in width direction X and vertical direction Z.

In this example, the air blowing device 210 is a sirocco fan (centrifugal fan) in a vortex-like scroll casing. The two flat plate portions 213*c* and 213*d* are circular when viewed from the front or the rear. The air guiding member 213 has a circular inlet port 213*a* at the center of any one of the two flat plate portions 213*c* and 213*d* (in this example, at the center of the flat plate portion 213*c*). The air guiding member 213 includes an extension portion 213*f* extending tangentially from circular parts of the two flat plate portions 213*c* and 213*d*. The extension portion 213*f* is provided with the ejection port 213*b*. The scroll casing of the air guiding member 213 is separable into two portions in depth direction Y. The air blowing blades 212 are of a forward curved type in which many blade sections 212*b* to 212*b* elongated in the axial direction are disposed in a row along the circumferences of circular frame bodies 212*a* and 212*a* on the outer circumferences of the frame bodies 212*a* and 212*a* that are disposed facing each other in depth direction Y.

The downstream duct 230 is hollow and has the air inlet port 231 (see FIG. 10) and the duct portion 232 (see FIG. 10). The air inlet port 231 is connected to the air outlet port 222 of the upstream duct 220. The duct portion 232 guides air W from the air inlet port 231 to the outside. The downstream duct 230 will be described later in detail.

In the present embodiment, the image forming apparatus 100 includes the ventilation section 112 (see FIGS. 1, 4 to 8, and 10) downstream of the downstream duct 230 in terms of the air blowing direction in which air W is blown by the air blowing device 210 (in the downstream proximity of the downstream duct 230: specifically, close to the downstream duct 230 (separated by a predetermined distance from the downstream duct 230) or in contact with the downstream duct 230). The air W blown by the air blowing device 210 strikes and passes through the ventilation section 112. The "air blowing direction in which air W is blown by the air blowing device 210" refers to the overall movement direction in which the air W blown by the air blowing device 210 and guided by the downstream duct 230 moves as a whole toward the ventilation section 112. In other words, the "air blowing direction of air W" refers to the direction in which the air W blown by the air blowing device 210 is guided as a whole by the downstream duct 230.

More specifically, the ventilation section 112 is made up of a struck portion that is struck by the air W blown by the air blowing device 210 and a passage portion that is passed through by the air W blown by the air blowing device 210. The passage portion is located adjacent to the struck portion. The image forming apparatus 100 is arranged to vent air W out of the image forming apparatus main body 110 (specifically, in the charging units 5*a* to 5*d* in the photosensitive body units 10*a* to 10*d*) via the air blowing device 210, the downstream duct 230, and the ventilation section 112 in the image forming apparatus main body 110.

Specifically, the opening section 112*a*, having openings 112*a*1 (see FIG. 1) to vent air W out of the image forming apparatus 100, is formed in that part of an exterior member (in this example, the right side exterior member 111*c*) of the image forming apparatus main body 110 which corresponds to the exit of the duct portion 232 (see FIG. 10) of the downstream duct 230. In this example, the filter 112*b* (see FIGS. 4 and 10) is disposed in the opening section 112*a*. The air W blown by the air blowing device 210 first strikes and passes through the filter 112*b*. After passing through the filter 112*b*, the air W then strikes and passes through the opening section 112*a*. In other words, the ventilation section 112 is made up of the opening section 112*a* and the filter 112*b* disposed in the opening section 112*a* (especially, the filter 112*b*, which the air W first strikes and passes through). The filter 112*b* is attached to the duct portion 232 of the downstream duct 230. In this example, the filter 112*b* is an ozone filter that removes ozone.

Downstream Duct

Next, the downstream duct 230 will be described in reference to FIGS. 13 to 17 as well as FIGS. 1 to 12.

Distorted Portion

Figure 13:
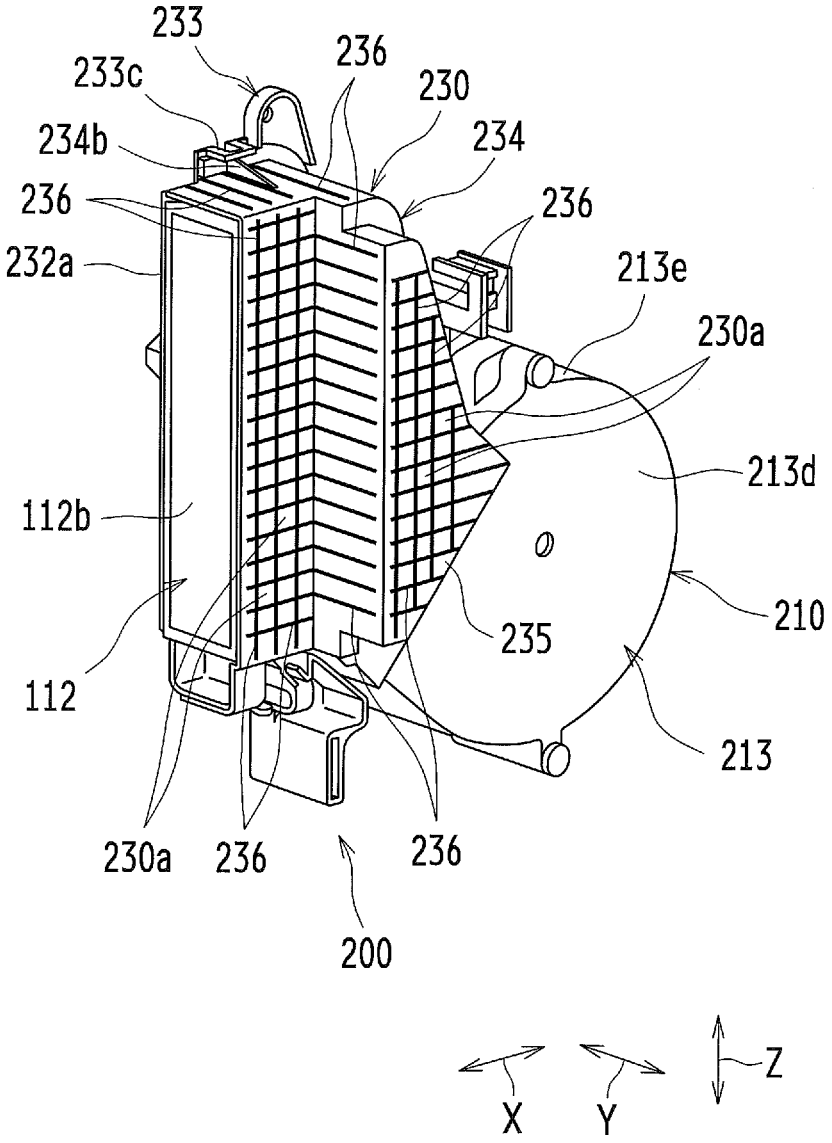
FIG. 13 is an oblique view of the rear side of the downstream duct and the air blowing device in the air blowing system in accordance with the first embodiment as viewed obliquely from above.
Figure 14:
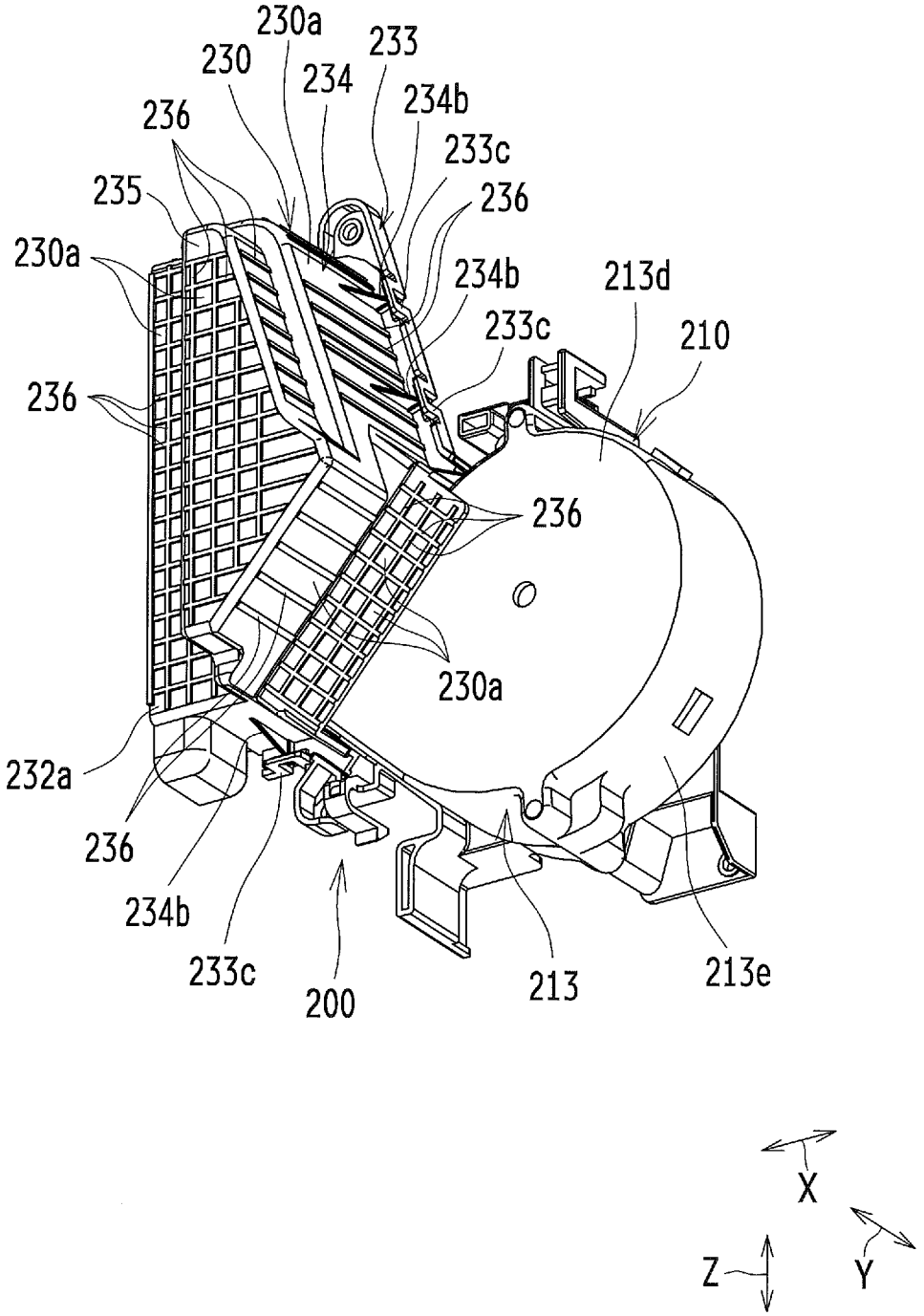
FIG. 14 is an oblique view of the rear side of the downstream duct and the air blowing device in the air blowing system in accordance with the first embodiment as viewed obliquely from below.
Figure 15:
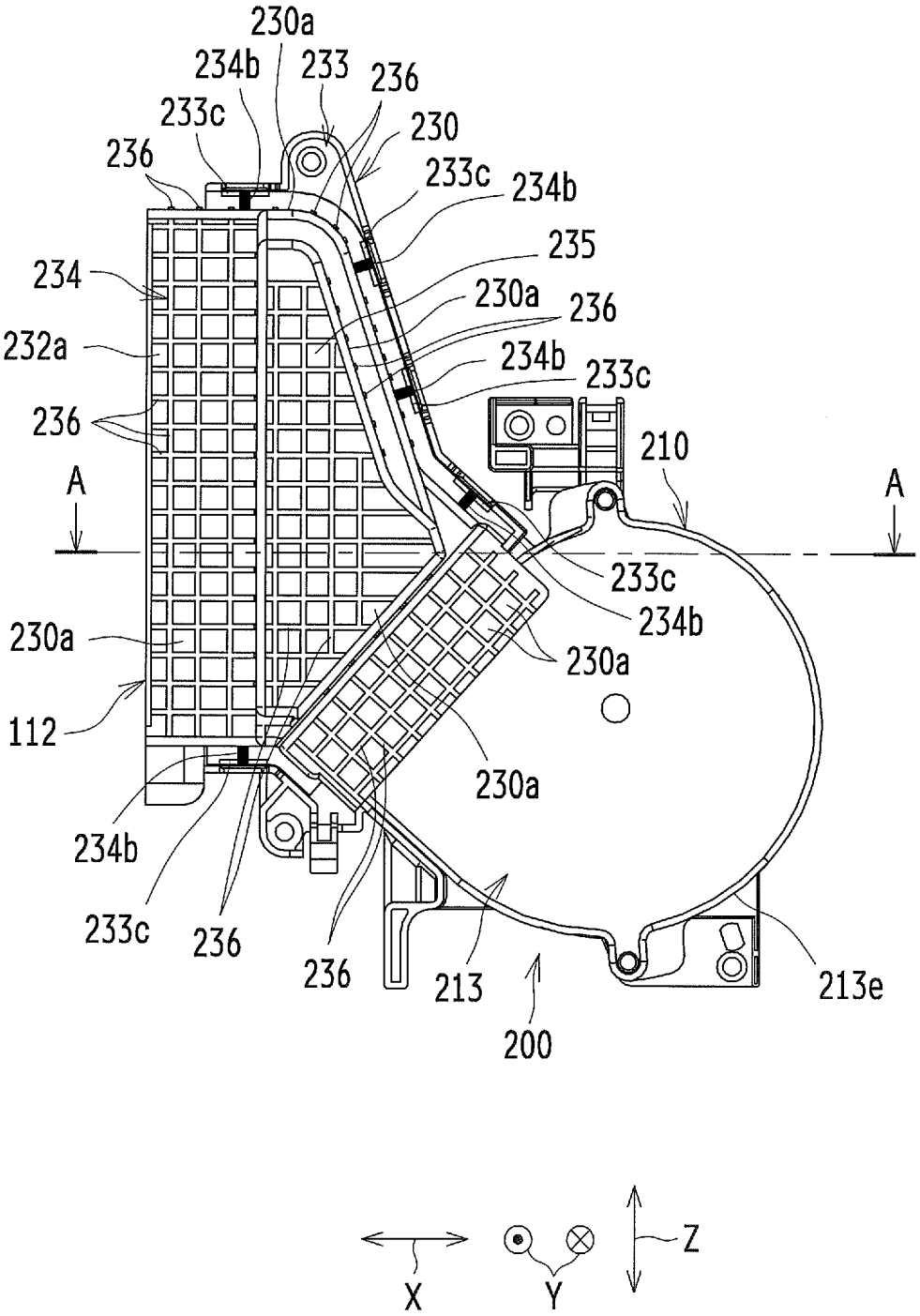
FIG. 15 is a rear view of the downstream duct and the air blowing device in the air blowing system in accordance with the first embodiment.
Figure 16:
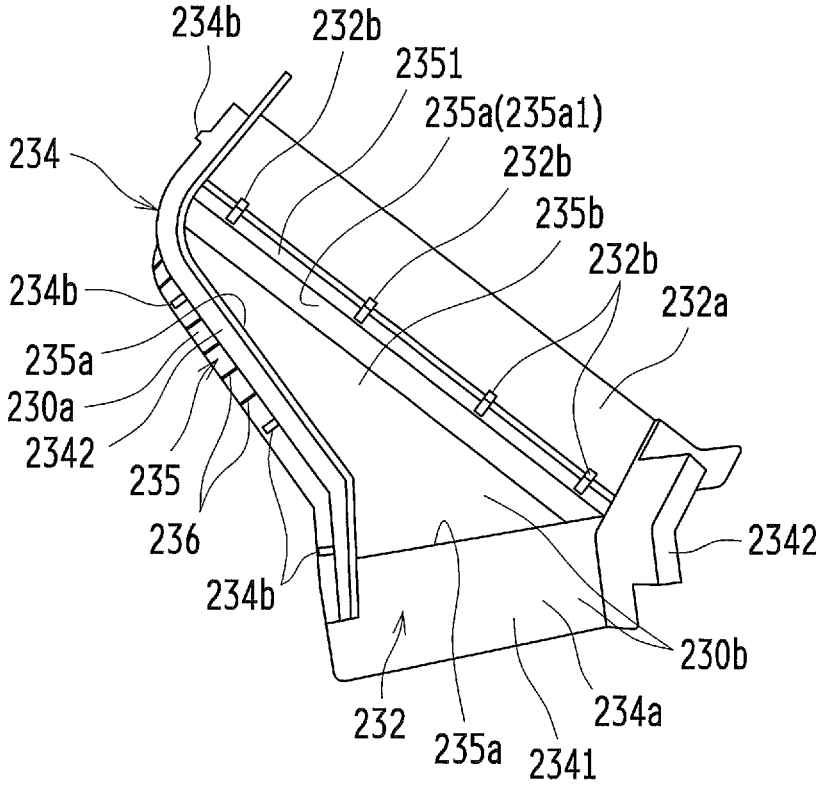
FIG. 16 is an oblique view of the inner side of the second duct cover member in the air blowing system in accordance with the first embodiment.
Figure 17:
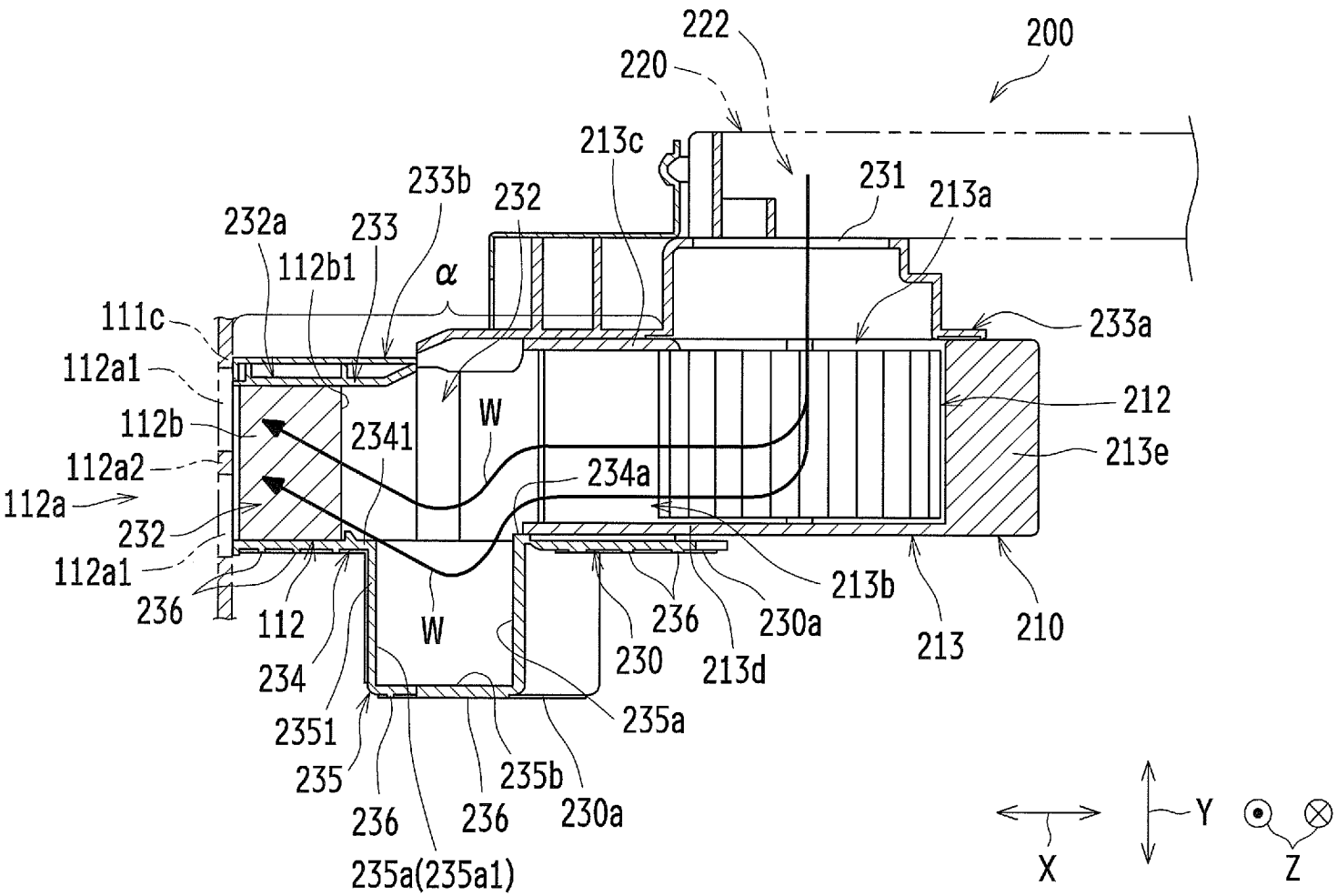
FIG. 17 is a schematic cross-sectional view of the downstream duct in the air blowing system in accordance with the first embodiment, taken along line A-A shown in FIG. 15.

FIG. 13 is an oblique view of the rear side of the downstream duct 230 and the air blowing device 210 in the air blowing system 200 in accordance with the first embodiment as viewed obliquely from above. FIG. 14 is an oblique view of the rear side of the downstream duct 230 and the air blowing device 210 in the air blowing system 200 in accordance with the first embodiment as viewed obliquely from below. FIG. 15 is a rear view of the downstream duct 230 and the air blowing device 210 in the air blowing system 200 in accordance with the first embodiment. FIG. 16 is an oblique view of the inner side of the second duct cover member 234 in the air blowing system 200 in accordance with the first embodiment. FIG. 17 is a schematic cross-sectional view of a downstream duct 230 in the air blowing system 200 in accordance with the first embodiment, taken along line A-A shown in FIG. 15.

The downstream duct 230 includes a distorted portion 235 (see FIGS. 3, 5, 6, 8, 9, 11, 13 to 16, and 17). The distorted portion 235 is a part of an inner wall face 234*a* (see FIGS. 16 and 17) of the downstream duct 230 located between the air blowing device 210 and the ventilation section 112 and distorted perpendicular or substantially perpendicular to the air blowing direction so that the air W blown by the air blowing device 210 flows perpendicularly or substantially perpendicularly to the air blowing direction.

There may be provided a single distorted portion 235 or a plurality of distorted portions 235 on the downstream duct 230 in the direction of the circumference of the downstream duct 230 that surrounds air W. Alternatively, the distorted portion(s) 235 may be provided across the entire circumference of the downstream duct 230. In this example, a single distorted portion 235 is provided on the downstream duct 230 in the direction of the circumference of the downstream duct 230 that surrounds air W.

The distorted portion 235, in the present embodiment, is a concave distortion where a part of the inner wall face 234*a* is distorted in a concave shape. The distorted portion 235 is a recess in the passageway of air W. The downstream duct 230 includes a linear duct portion (linear portion) a (see FIG. 17) between the air blowing device 210 and the ventilation section 112. The distorted portion 235 is provided in the linear duct portion α. In addition, the distorted portion 235, when it is a concave distortion, is such that a wall face 235*a* (235*a*1) that is closest to the ventilation section 112 is perpendicular or substantially perpendicular to at least the air blowing direction of air W. More specifically, the distorted portion 235 is a concave distortion with a plurality of wall faces 235*a* to 235*a* (see FIGS. 16 and 17) and a bottom face 235*b* (see FIGS. 16 and 17). Of the plurality of wall faces 235*a* to 235*a*, at least the wall face 235*a* (235*a*1) closest to the ventilation section 112 (the wall face 235*a*1, of an intersecting duct portion 2351, closest to the ventilation section 112) is perpendicular or substantially perpendicular to the air blowing direction of air W. In this example, all the wall faces 235*a* to 235*a* of the distorted portion 235 are perpendicular or substantially perpendicular to the air blowing direction of air W.

The distorted portion 235, in the present embodiment, is provided across the substantially entire inner wall face 234*a* in terms of the air blowing direction between the air blowing device 210 and the ventilation section 112 on one of the sides of the downstream duct 230 for air Win terms of depth direction Y. The distorted portion 235 is provided across the substantially entire inner wall face 234*a* in terms of vertical direction Z between the air blowing device 210 and the ventilation section 112 on one of the sides of the downstream duct 230 in terms of depth direction Y.

The ventilation section 112, in the present embodiment, has an air entering face 112*b*1 (of the filter 112*b* in this example; see FIGS. 10 and 17) where the air W blown by the air blowing device 210 enters the ventilation section 112. The downstream duct 230 and the air blowing device 210 are arranged so that the air blowing direction of the air W inclines relative to the air entering face 112*b*1 of the ventilation section 112. More specifically, the downstream duct 230 and the air blowing device 210 are arranged so that the air blowing direction of the air W inclines, relative to the air entering face 112*b*1 of the ventilation section 112, in a non-distorting direction (in this example, a direction perpendicular or substantially perpendicular to depth direction Y) that is different from a distorting direction (in this example, depth direction Y) in which a part of the inner wall face 234*a* is distorted to form the distorted portion 235. The "direction perpendicular or substantially perpendicular to depth direction Y" in this context refers to a direction parallel or substantially parallel to a virtual plane that extends both in width direction X and in vertical direction Z. The air entering face 112*b*1 of the ventilation section 112, in this example, is perpendicular or substantially perpendicular to width direction X.

Specifically, the downstream duct 230 progressively increases in dimension in vertical direction Z toward its downstream end in terms of the air blowing direction of the air W from the air blowing device 210.

The downstream duct 230 includes a first duct cover member 233 (see, FIGS. 3 to 11, 13 to 15, and 17) and the second duct cover member 234 (see FIGS. 3 to 6, 8 to 9, 11, and 13 to 17). The first duct cover member 233, facing the upstream duct 220, constitutes one of two ends (front side end) of the downstream duct 230 in terms of depth direction Y. The second duct cover member 234, joined to the first duct cover member 233, constitutes the other end (rear side end) of the downstream duct 230 in terms of depth direction Y. The second duct cover member 234 is attachable to the first duct cover member 233. With the second duct cover member 234 being attached to the first duct cover member 233, the downstream duct 230 is partially constituted by the duct portion 232 (see FIGS. 10, 16, and 17).

The first duct cover member 233 is secured to a frame FL (see FIGS. 5 and 6) of the image forming apparatus main body 110 by screws or other securing members, with the air inlet port 231 (see FIG. 10) being connected to the air outlet port 222 of the upstream duct 220 (see FIG. 10).

The first duct cover member 233 includes an air blowing device receptacle 233*a* in which the air blowing device 210 is disposed (see FIG. 10) and a duct-constituting portion 233*b* that, when the second duct cover member 234 is attached to the duct-constituting portion 233*b*, constitutes the duct portion 232 (see FIG. 10).

In the first duct cover member 233, the air blowing device receptacle 233*a* and the duct-constituting portion 233*b* are disposed so that virtual straight line β extending parallel to the air blowing direction of the air W flowing in the duct portion 232 (see FIG. 10) intersects virtual normal γ to the air entering face 112*b*1 of the ventilation section 112 (see FIG. 10) (in this example, the air blowing device receptacle 233*a* is located below the duct-constituting portion 233*b*). Hence, the air W from the air blowing device 210 strikes the air entering face 112*b*1 obliquely (in this example, obliquely from below).

The first duct cover member 233 includes a base plate 2331 (see FIG. 10) and support plates 2332 and 2332 (see FIG. 10). The base plate 2331 extends perpendicular or substantially perpendicular to depth direction Y. The support plates 2332 and 2332 are erected on that part of the outer circumference of the base plate 2331 which is close to the air blowing device 210, so as to support the second duct cover member 234. The support plates 2332 and 2332 are disposed on the duct-constituting portion 233*b*. The support plates 2332 and 2332 are partially inclined along virtual straight line β and, in conjunction with the second duct cover member 234 and the duct-constituting portion 233*b* of the base plate 2331, also serve as a guiding portion that guides air W from the air blowing device 210 toward the ventilation section 112. The air blowing device receptacle 233*a* of the first duct cover member 233 has a circular dent 2333 (see FIG. 10) to accommodate the inlet port 213*a* (see FIG. 12) of the air blowing device 210. The air inlet port 231 is provided at the center of the bottom face of the dent 2333.

The first duct cover member 233 secures and supports the air blowing device 210 with screws or other like securing members, with the dent 2333 in the air blowing device receptacle 233*a* accommodating the inlet port 213*a* (see FIG. 12) of the air blowing device 210 and with the support plates 2332 and 2332 sandwiching the extension portion 213*f* (see FIG. 12) of the air blowing device 210.

The second duct cover member 234 is arranged to guide air W from the air blowing device 210 toward the ventilation section 112 in conjunction with the duct-constituting portion 233*b* of the first duct cover member 233.

The distorted portion 235 is a part of the second duct cover member 234. The distorted portion 235 is formed by altering the shape of the second duct cover member 234.

The distorted portion 235 of the second duct cover member 234 is a dent in the inner wall face 234*a*. The inner wall face 234*a* extends perpendicular or substantially perpendicular to depth direction Y, and the dent is formed perpendicular or substantially perpendicular to the air blowing direction of the air W blown by the air blowing device 210 (in this example, formed in depth direction Y toward the aforementioned other end (rear side end)). In other words, the distorted portion 235 has the wall faces 235*a* to 235*a*, which are perpendicular or substantially perpendicular to the inner wall face 234*a* of the second duct cover member 234 (see FIGS. 16 and 17), and the bottom face 235*b*, which are joined to the wall faces 235*a* to 235*a* and perpendicular or substantially perpendicular to the wall faces 235*a* to 235*a* (parallel or substantially parallel to the inner wall face 234*a* of the second duct cover member 234) (see FIGS. 16 and 17).

The second duct cover member 234 has a first guiding portion 2341 perpendicular or substantially perpendicular to depth direction Y (see FIGS. 16 and 17) and second guiding portions 2342 and 2342 where the second duct cover member 234 is bent away from the first guiding portion 2341 toward the first duct cover member 233 in a part of the outer circumference of the first guiding portion 2341 (see FIG. 16). The distorted portion 235 is a part of the first guiding portion 2341. The second guiding portions 2342 and 2342 are partially inclined along virtual straight line β (see FIG. 10). The second guiding portions 2342 and 2342 also serve as attachment portions attached to the exterior of the support plates 2332 and 2332 of the first duct cover member 233. The second duct cover member 234 is secured to the first duct cover member 233 by their depressions and projections. In this example, The second duct cover member 234 has an outer circumferential surface on which a plurality of engagement projection portions 234*b* to 234*b* (see FIGS. 3, 5, 6, 8, 9, 11, and 13 to 16) are formed. The first duct cover member 233 has a peripheral section, facing the second duct cover member 234, on which a plurality of catching hole portions 233*c* to 233*c* (see FIGS. 3, 5, 6, 8 to 11, and 13 to 15) are formed to respectively catch the plurality of engagement projection portions 234*b* to 234*b*. The second duct cover member 234 is secured to the first duct cover member 233 by the plurality of engagement projection portions 234*b* to 234*b* being inserted into the plurality of catching hole portions 233*c* to 233*c* of the first duct cover member 233.

The downstream duct 230 has a filter attachment portion 232*a* to which the filter 112*b* is attached (see FIGS. 3 to 8, 10, 11, and 13 to 17). The filter attachment portion 232*a* is disposed at the exit of the duct portion 232 of the downstream duct 230. The filter attachment portion 232*a* has an internal shape that matches the external shape of the filter 112*b* in the direction of the circumference of the filter 112*b*. The filter attachment portion 232*a* has an internal shape that has slightly greater dimensions than the external shape of the filter 112*b* in the direction of the circumference of the filter 112*b* ("greater" by predetermined amounts such that the filter 112*b* can be smoothly attached when the filter 112*b* is attached on the exit end of the duct portion 232). The duct portion 232 has a regulatory section 232*b* that regulates movement in the direction in which the filter 112*b* is attached (direction opposite the air blowing direction of air W) (see FIGS. 10 and 16). In this example, the regulatory section 232*b* is a plurality of regulatory projections disposed in a row extending in the direction of the circumference of the duct portion 232. The regulatory section 232*b* is provided both on the first duct cover member 233 and on the second duct cover member 234.

The opening section 112*a* (see FIG. 17), which constitutes a part of the ventilation section 112, includes an exterior cover section 112*a*2 that the air W blown by the air blowing device 210 strikes. The exterior cover section 112*a*2 has one or multiple (in this example, multiple) openings 112*a*1 to 112*a*1 (in this example, slits each elongated in depth direction Y). The air W blown by the air blowing device 210 strikes the exterior cover section 112*a*2 and passes through the openings 112*a*1 through the exterior cover section 112*a*2.

The filter 112*b*, which constitutes a part of the ventilation section 112, is polyhedral. The filter 112*b*, in this example, is hexahedral and more specifically has a rectangular parallelepiped shape elongated in vertical direction Z. The filter 112*b* has a smaller dimension in width direction X than in depth direction Y.

Figure 18:
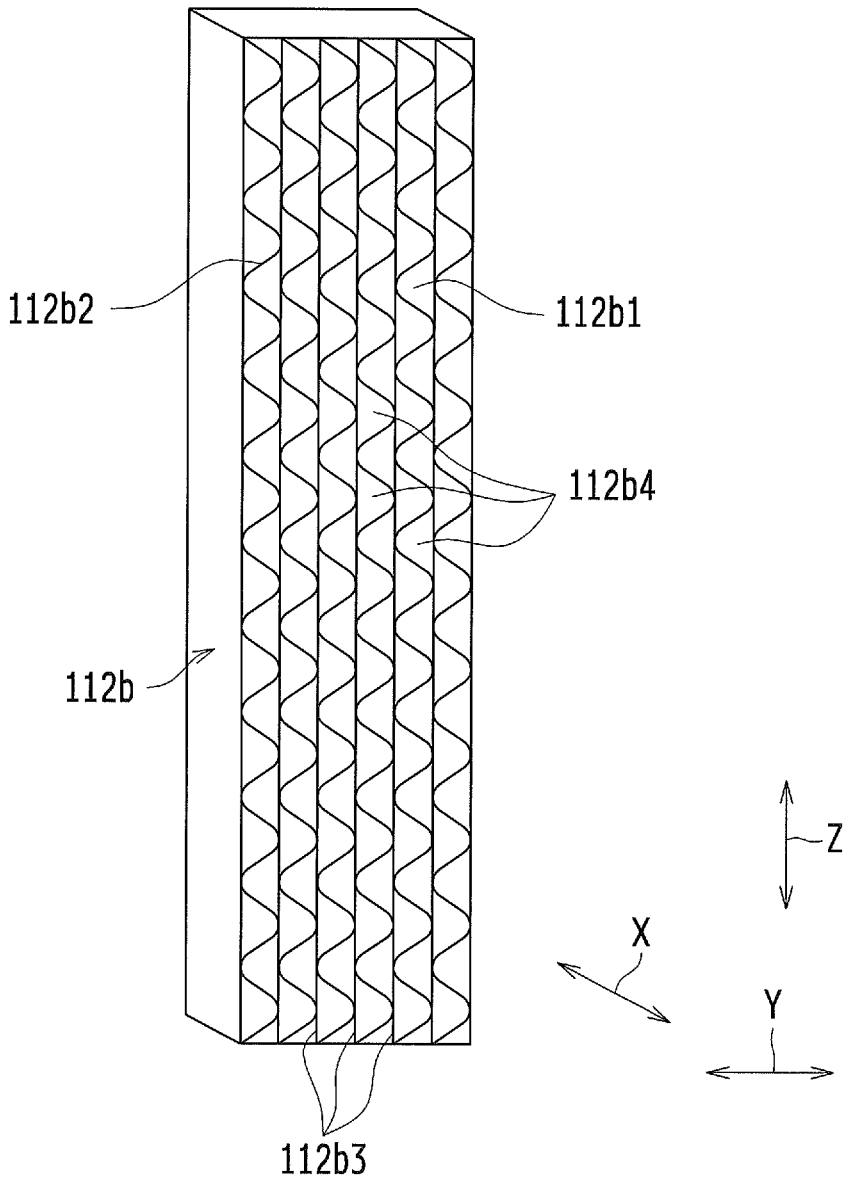
FIG. 18 is an oblique view of a filter disposed on the downstream duct as viewed from the air entering face side.

FIG. 18 is an oblique view of the filter 112*b* disposed on the downstream duct 230 as viewed from the air entering face 112*b*1 side. FIG. 18 depicts the internal structure in an enlarged manner for clarity. The actual internal structure is much finer.

As illustrated in FIG. 18, the filter 112*b*, in this example, includes a wavy sheet 112*b*2 and flat sheets 112*b*3 and 112*b*3 that the air W blown by the air blowing device 210 strikes. The wavy sheet 112*b*2 (e.g., activated carbon carrying sheet) has a wavelike shape undulating in vertical direction Z. The flat sheets 112*b*3 and 112*b*3 are perpendicular or substantially perpendicular to depth direction Y. The filter 112*b* is constituted by the wavy sheet 112*b*2 being sandwiched in depth direction Y by the flat sheets 112*b*3 and 112*b*3 on both sides of the wavy sheet 112b2. The air W blown by the air blowing device 210 strikes the wavy sheet 112b2 and the flat sheets 112b3 and 112b3 and passes through gaps 112b4 between the wavy sheet 112b2 and the flat sheets 112b3 and 112b3.

The wavy sheet 112b2 of the filter 112b undulates in vertical direction Z in this example and alternatively may undulate in depth direction Y. In the latter arrangement, the wavy sheet 112b2, undulating in depth direction Y, is sandwiched in vertical direction Z by the flat sheets 112b3 and 112b3 on both sides of the wavy sheet 112b2.

Surface Area Reducing Portion

The downstream duct 230 has an outer surface 230a on at least a part of which there is provided a surface area reducing portion 236 for reducing the surface area of a continuous face (see FIGS. 3 to 9, 11, and 13 to 17). A "continuous face" herein refers to a face with no or substantially no macroscopic irregularities or bends. Example of continuous faces include planes, spherical surfaces, and curved surfaces. In this example, the continuous face is a plane.

The downstream duct 230, in the present embodiment, has the intersecting duct portion 2351 in the direction that intersects (in this example, at or substantially at right angles) the air blowing direction in which air W is blown by the air blowing device 210 (see FIGS. 16 and 17). The intersecting duct portion 2351 is oriented so that the air W blown by the air blowing device 210 can strike the wall face 235a (235a1). The surface area reducing portion 236 is provided at least on the intersecting duct portion 2351, which is oriented so that the air W blown by the air blowing device 210 can strike the wall face 235a (235a1).

The surface area reducing portion 236, in the present embodiment, is formed in a convex shape integrally with at least a part of the outer surface 230a of the downstream duct 230. The surface area reducing portion 236 is a demarcating portion that demarcates at least a part of the outer surface 230a of the downstream duct 230. The surface area reducing portion 236 has a latticed part.

Specifically, the surface area reducing portion 236 is provided across the outer surface 230a of the second duct cover member 234. The second duct cover member 234 is approximately 1.5 mm thick. The surface area reducing portion 236 is approximately 0.5 mm to 1 mm high and approximately 0.5 mm to 1 mm wide. The latticed part of the surface area reducing portion 236 measures approximately 5 mm to 8 mm in both width and length.

The second duct cover member 234 and the surface area reducing portion 236 are formed using a die and in this example, pulled out of the die in a direction parallel to depth direction Y. For this reason, the surface area reducing portion 236, provided on that part of the outer surface 230a of the second duct cover member 234 which extends in depth direction Y, is linear in depth direction Y.

Second Embodiment

Ribs in Downstream Duct

Figure 19:
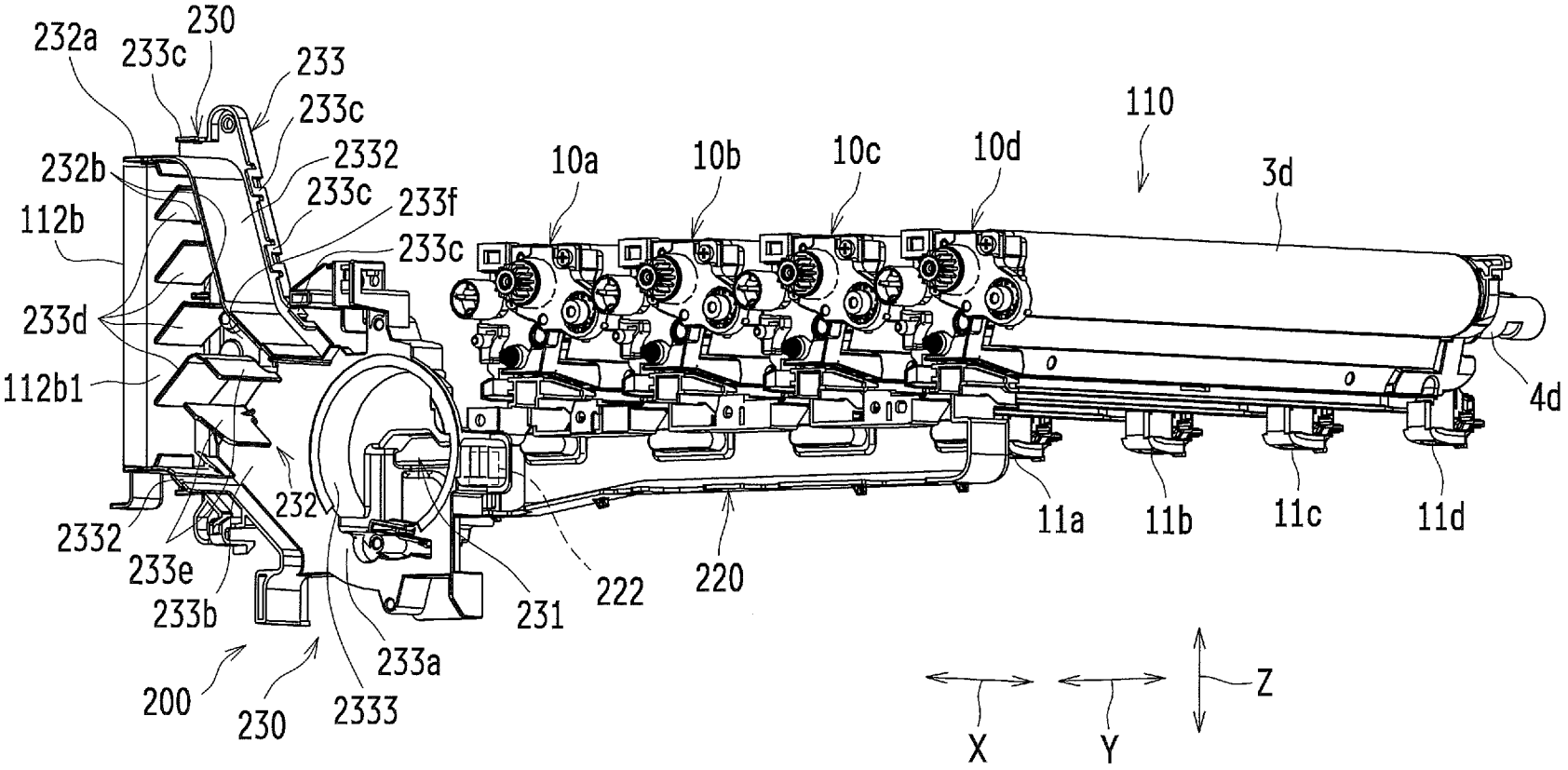
FIG. 19 is an oblique view of the rear side of an air blowing system in accordance with a second embodiment as viewed from the left, with an air blowing device and a second duct cover member for a downstream duct being removed.
Figure 20:
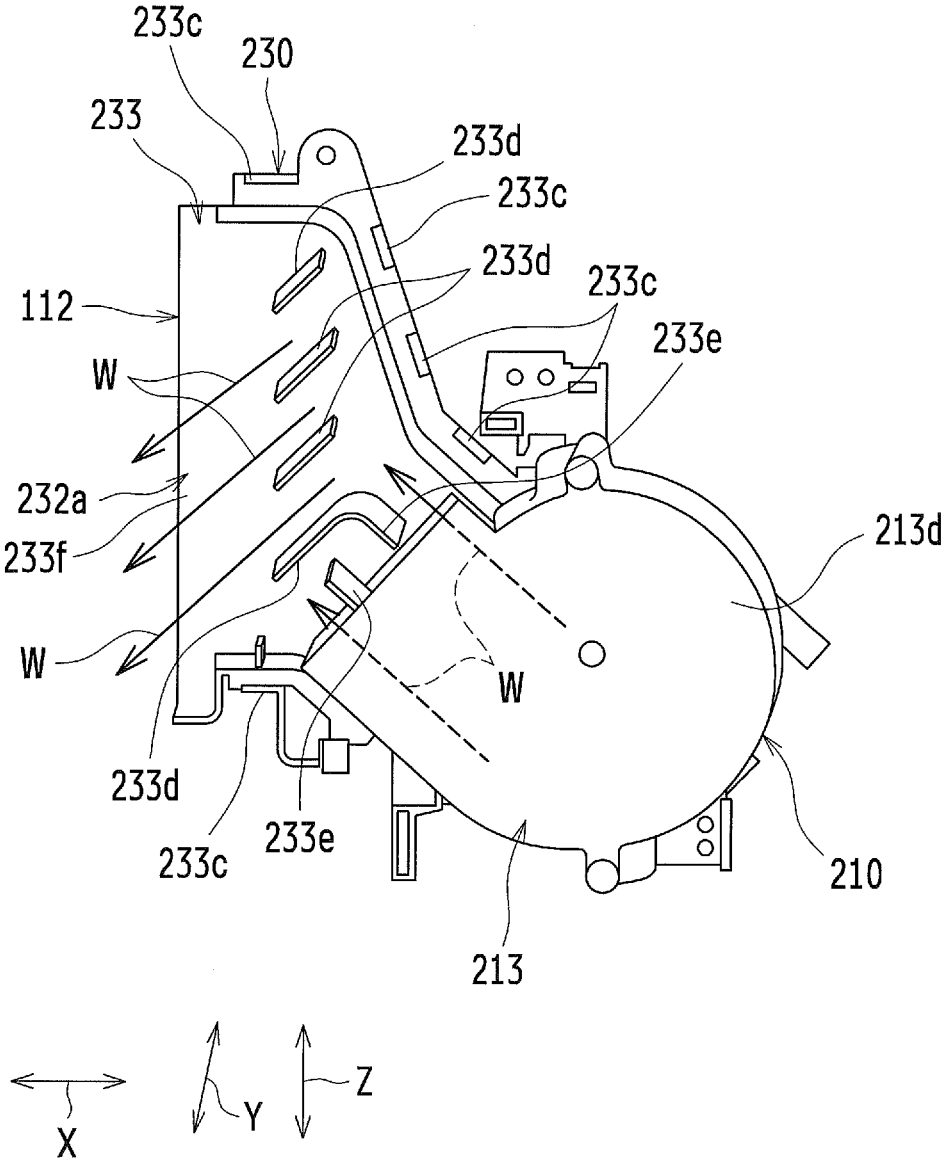
FIG. 20 is an oblique view of the rear side of the air blowing system in accordance with the second embodiment as viewed slightly obliquely from above, with the second duct cover member for the downstream duct and a filter being removed.

FIG. 19 is an oblique view of the rear side of the air blowing system 200 in accordance with the second embodiment as viewed from the left, with the air blowing device 210 and the second duct cover member 234 for the downstream duct 230 being removed. FIG. 20 is an oblique view of the rear side of the air blowing system 200 in accordance with the second embodiment as viewed slightly obliquely from above, with the second duct cover member 234 for the downstream duct 230 and the filter 112b being removed. FIG. 19 depicts the air blowing system 200 being attached to the charging units 5a to 5d in the photosensitive body units 10a to 10d.

As illustrated in FIGS. 19 and 20, the downstream duct 230 has an inner surface on which there are provided deflecting ribs 233d serving as ribs that deflect the air W blown by the air blowing device 210 in a deflecting direction different from the air blowing direction. More specifically, the deflecting direction is a non-distorting direction (in this example, a direction perpendicular or substantially perpendicular to depth direction Y) that is different from a distorting direction (in this example, depth direction Y) in which a part of the inner wall face 234a is distorted to form the distorted portion 235. The deflecting direction is also an intersecting direction that intersects the air blowing direction. The deflecting ribs 233d are shaped like plates extending in the deflecting direction (more specifically, in the intersecting direction). There may be provided one or multiple (in this example, four) deflecting ribs 233d parallel to each other in vertical direction Z.

The deflecting ribs 233d to 233d are disposed on other parts of the inner surface than the part where the distorted portion 235 is provided. More specifically, the deflecting ribs 233d to 233d are erected (in this example, at or substantially at right angles) on at least one of the wall faces of the downstream duct 230 containing the air W, specifically, on at least one of the wall faces other than the wall face where the distorted portion 235 is provided (in this example, on an inner wall face 233f of the first duct cover member 233). The deflecting ribs 233d to 233d are formed as a single piece with the first duct cover member 233.

There are provided guiding ribs 233e on the inner surface of the downstream duct 230, upstream of the deflecting ribs 233d in terms of the air blowing direction. The guiding ribs 233e guide the air W blown by the air blowing device 210 in the air blowing direction. The guiding ribs 233e are shaped like plates extending in the air blowing direction of the air W. There may be provided one or multiple (in this example, two) guiding ribs 233e parallel to each other in vertical direction Z.

The guiding ribs 233e to 233e are disposed on other parts of the inner surface than the part where the distorted portion 235 is provided. More specifically, the guiding ribs 233e to 233e are erected (in this example, at or substantially at right angles) on at least one of the wall faces of the downstream duct 230 containing the air W, specifically, on at least one of the wall faces other than the wall face where the distorted portion 235 is provided (in this example, on the inner wall face 233f of the first duct cover member 233). The guiding ribs 233e to 233e are formed as a single piece with the first duct cover member 233. At least one of the guiding ribs 233e to 233e (in this example, the uppermost guiding rib 233e) is coupled to at least one of the deflecting ribs 233d to 233d (in this example, the lowermost deflecting rib 233d).

Third Embodiment

Distorted Portion

In the preceding embodiments the distorted portion 235 is a concave distortion where a part of the inner wall face 234a is distorted in a concave shape, which is by no means intended to be limiting the invention. Additionally or alternatively, the distorted portion 235 may be a convex distortion where a part of the inner wall face 234a is distorted in a convex shape.

Figure 21:
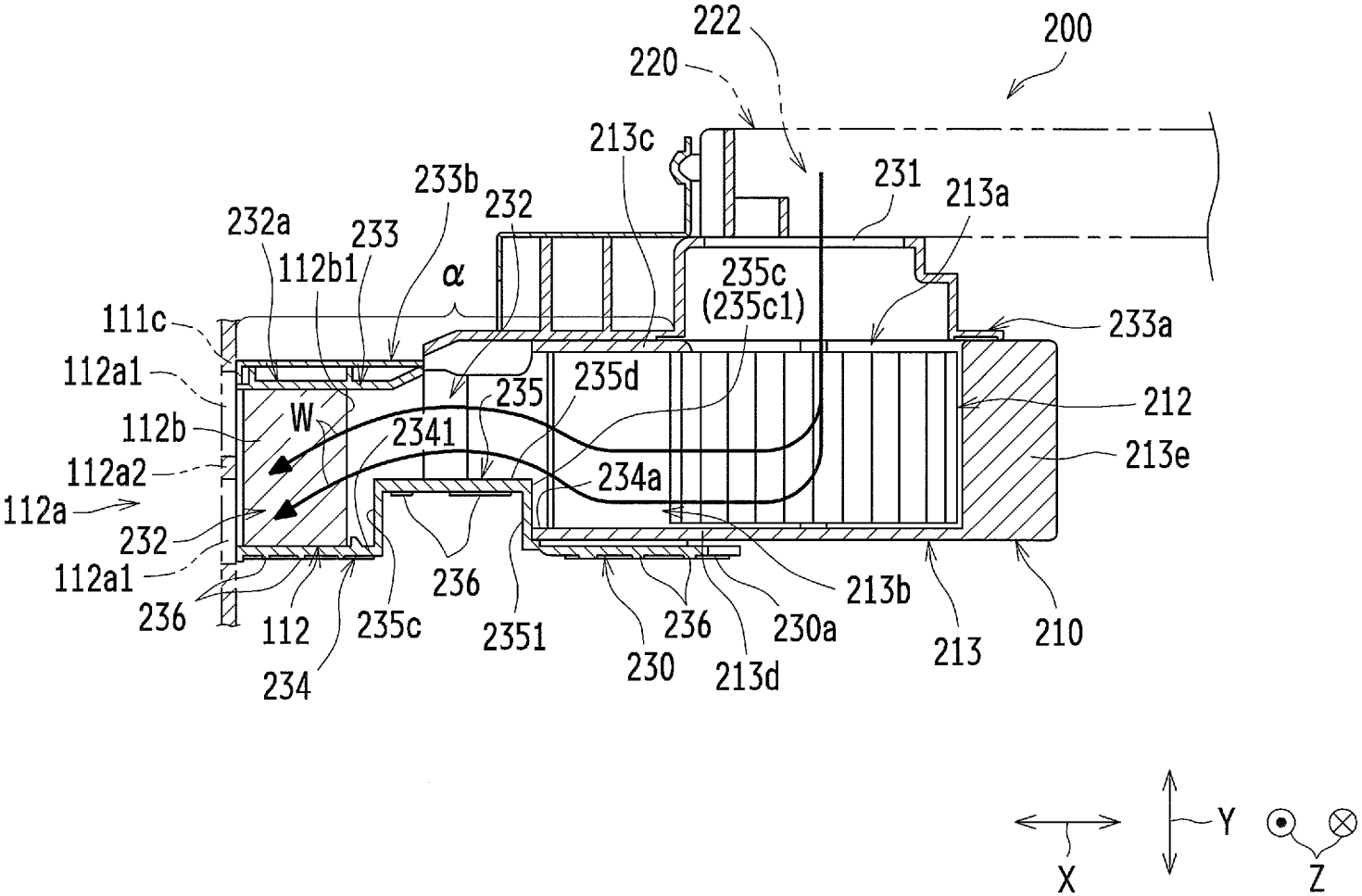
FIG. 21 is a schematic cross-sectional view of an example of a downstream duct having as a distorted portion a convex distortion where a part of an inner wall face of the downstream duct is distorted in a convex shape.

FIG. 21 is a schematic cross-sectional view of an example of the downstream duct 230 having as the distorted portion 235 a convex distortion where a part of the inner wall face 234*a* is distorted in a convex shape.

The distorted portion 235, being a convex distortion where a part of the inner wall face 234*a* is distorted in a convex shape, blocks the passageway of air W. The distorted portion 235, being a convex distortion, has at least a wall face 235*c* (235*c*1) that is farthest from the ventilation section 112 and perpendicular or substantially perpendicular to the air blowing direction of air W. More specifically, the distorted portion 235 is a convex distortion with a plurality of wall faces 235*c* to 235*c* and a top face 235*d*. Of the plurality of wall faces 235*c* to 235*c*, at least the wall face 235*c* (235*c*1) farthest from the ventilation section 112 (the wall face 235*c*1 of the intersecting duct portion 2351 farthest from the ventilation section 112) is perpendicular or substantially perpendicular to the air blowing direction of air W. In this example, all the wall faces 235*c* to 235*c* of the distorted portion 235 are perpendicular or substantially perpendicular to the air blowing direction of air W.

The second duct cover member 234 is arranged to guide air W from the air blowing device 210 toward the ventilation section 112 in conjunction with the duct-constituting portion 233*b* of the first duct cover member 233.

The distorted portion 235 is a part of the second duct cover member 234. The distorted portion 235 is formed by altering the shape of the second duct cover member 234.

The distorted portion 235 of the second duct cover member 234 is a bump on the inner wall face 234*a*. The inner wall face 234*a* extends perpendicular or substantially perpendicular to depth direction Y, and the bump is formed perpendicular or substantially perpendicular to the air blowing direction of the air W blown by the air blowing device 210 (in this example, formed in depth direction Y toward the aforementioned one of two ends (front side end)). In other words, the distorted portion 235 has: the wall faces 235*c* to 235*c*, which are perpendicular or substantially perpendicular to the inner wall face 234*a* of the second duct cover member 234; and the top face 235*d*, which are joined to the wall faces 235*c* to 235*c* and perpendicular or substantially perpendicular to the wall faces 235*c* to 235*c* (parallel or substantially parallel to the inner wall face 234*a* of the second duct cover member 234).

The distorted portion 235, when it is a convex distortion, may be arranged in the same manner as it is arranged when it is a concave distortion.

Fourth Embodiment

Surface Area Reducing Portion

In the preceding embodiments, the surface area reducing portion 236 is provided on at least a part of the outer surface 230*a* of the downstream duct 230, which is by no means intended to be limiting the invention. Additionally or alternatively, the surface area reducing portion 236 may be provided on at least a part of the inner surface 230*b* of the downstream duct 230 (see FIGS. 10 and 16). For example, the surface area reducing portion 236 may be provided across the entire inner surface 230*b* of the second duct cover member 234.

The surface area reducing portion 236, when it is provided on at least a part of the inner surface 230*b* of the downstream duct 230, may be arranged in the same manner as it is arranged when it is provided on at least a part of the outer surface 230*a* of the downstream duct 230.

Fifth Embodiment

Air Blowing System

In the preceding embodiments, the air blowing system 200 includes an ozone removing system applied to the charging units 5*a* to 5*d* in the photosensitive body units 10*a* to 10*d*, which is by no means intended to be limiting the invention. The air blowing system 200 may include an air cooling system that cools heat generating members, including the fixing apparatus 7 and various other electric members, with air. In addition, the air blowing system 200 is applied to the image forming apparatus main body 110, which is by no means intended to be limiting the invention. For example, the air blowing system 200 may be applied to various members in the image forming apparatus: namely, various processing units including the image scanning device, the paper feeder desk, the large-capacity paper feed tray, and optional processing units.

Sixth Embodiment

Filter

In the preceding embodiments, the ventilation section 112 includes the filter 112*b*. The ventilation section 112 may include no filter 112*b*, in which case the air W blown by the air blowing device 210 strikes and passes through the opening section 112*a*. The filter 112*b* may be, for example, a purification filter that removes fine particles, such as dust and toner, either in addition to being an ozone filter or if the air blowing system 200 includes no ozone removing system, instead of being an ozone filter.

Seventh Embodiment

Air Blowing Device

In the preceding embodiments, the air blowing device 210 is a sirocco fan, which is by no means intended to be limiting the invention. The air blowing device 210 may be a propeller fan (axial or diagonal flow fan) or a cross flow fan (transverse fan) according to its usage and purpose.

Preceding Embodiments (Distorted Portion)

In the air blowing system 200 in accordance with the preceding embodiments, when the air W blown by the air blowing device 210 is to be vented out of the image forming apparatus 100, the air blowing device 210 is driven. The air blowing device 210 then sucks in the air W from a target member (in this example, the charging units 5*a* to 5*d* in the photosensitive body units 10*a* to 10*d*) and guides the sucked air W through the downstream duct 230 serving as the duct in accordance with the preceding embodiments, to vent the air W via the ventilation section 112 of the image forming apparatus 100 to the outside. Specifically, the air W sucked in through the air outlet ports 12*a* to 12*d* of the charging units 5*a* to 5*d* and the air inlet ports 221*a* to 221*d* of the upstream duct 220 is merged in the upstream duct 220, guided through the air outlet port 222 of the upstream duct 220 and the inlet port 213*a* and the ejection port 213*b* of the air blowing device 210, passed through the duct portion 232 and further through the filter 112*b* and the opening section 112*a*, which constitute the ventilation section 112, and vented to the outside.

In this venting, conventional technology produces a whistling sound when the air blown by the air blowing device passes through the ventilation section.

This problem is addressed by the preceding embodiments. The downstream duct 230 includes the distorted portion 235 where a part of the inner wall face 234*a* located between the air blowing device 210 and the ventilation section 112 is distorted perpendicular or substantially perpendicular to the air blowing direction, so that the air W blown by the air blowing device 210 can flow perpendicularly or substantially perpendicularly to the air blowing direction. This structure can cause the air W blown by the air blowing device 210 to temporarily flow perpendicularly or substantially perpendicularly to the air blowing direction in the distorted portion 235. That in turn changes the flow of the air W in the distorted portion 235, enabling altering of the angle at which the air W blown by the air blowing device 210 strikes the ventilation section 112. Especially, the air blowing direction of the air W can incline relative to the air entering face 112*b*1 of the ventilation section 112. The structure can hence reduce the whistling sound produced when the air W blown by the air blowing device 210 passes through the ventilation section 112.

As in the preceding embodiments, as well as in the third embodiment, the distorted portion 235 may be a convex distortion where a part of the inner wall face 234*a* is distorted in a convex shape. When this is actually the case, the distorted portion (convex distortion) 235 blocks the air W blown by the air blowing device 210, likely to resulting in poor air blowing efficiency of the air blowing device 210.

This problem is addressed by the preceding embodiments, except for by the third embodiment. The distorted portion 235, being a concave distortion where a part of the inner wall face 234*a* is distorted in a concave shape, can cause the air W blown by the air blowing device 210 to flow perpendicularly or substantially perpendicularly to the air blowing direction of the air W, without blocking the air W. The structure can hence reduce the whistling sound produced when the air W blown by the air blowing device 210 passes through the ventilation section 112 while maintaining the air blowing efficiency of the air blowing device 210.

When there is provided a linear portion (linear duct portion α) between the air blowing device 210 and the ventilation section 112 as in the preceding embodiments, the air W blown by the air blowing device 210 could flow in the linear portion (linear duct portion α) without altering its direction until it strikes the ventilation section. Whistling sound would likely be produced when the air W blown by the air blowing device 210 passes through the ventilation section 112.

This potential problem is taken into account by the preceding embodiments. The linear portion (linear duct portion α), although being provided between the air blowing device 210 and the ventilation section 112, includes the distorted portion 235. This structure can efficiently prevent the air W blown by the air blowing device 210 from flowing in the linear portion (linear duct portion α) without altering its direction until it strikes the ventilation section 112. For this reason, the structure can also contribute to the reduction of the whistling sound produced when the air W blown by the air blowing device 210 passes through the ventilation section 112.

As in the preceding embodiments, except for the third embodiment, when the distorted portion 235 is a concave distortion, it is the wall face 235*a* (235*a*1) closest to the ventilation section 112 that, of all the wall faces, is more likely to efficiently alter the angle at which the air W blown by the air blowing device 210 strikes the ventilation section 112.

From such a point of view, in the preceding embodiments, except for in the third embodiment, the distorted portion 235, being a concave distortion, can efficiently alter the angle at which the air W blown by the air blowing device 210 strikes the ventilation section 112 because at least the wall face 235*a* (235*a*1) closest to the ventilation section 112 is perpendicular or substantially perpendicular to the air blowing direction of the air W. For this reason, this structure can also contribute to the reduction of the whistling sound produced when the air W blown by the air blowing device 210 passes through the ventilation section 112. Besides, since the wall face 235*a* (235*a*1) closest to the ventilation section 112 is perpendicular or substantially perpendicular to the air blowing direction of the air W, the downstream duct 230 can be reduced in size in the air blowing direction. For this reason, the structure can also contribute to the reduction in size of the downstream duct 230.

As in the preceding embodiments, as well as in the third embodiment, when the distorted portion 235 is a convex distortion, it is the wall face 235*c* (235*c*1) farthest from the ventilation section 112 that, of all the wall faces, is more likely to efficiently alter the angle at which the air W blown by the air blowing device 210 strikes the ventilation section 112.

From such a point of view, in the preceding embodiments, as well as in the third embodiment, the distorted portion 235, being a convex distortion, can efficiently alter the angle at which the air W blown by the air blowing device 210 strikes the ventilation section 112 because at least the wall face 235*c* (235*c*1) farthest from the ventilation section 112 is perpendicular or substantially perpendicular to the air blowing direction of the air W. For this reason, this structure can also contribute to the reduction of the whistling sound produced when the air W blown by the air blowing device 210 passes through the ventilation section 112. Besides, since the wall face 235*c* (235*c*1) farthest from the ventilation section 112 is perpendicular or substantially perpendicular to the air blowing direction of the air W, the downstream duct 230 can be reduced in size in the air blowing direction. For this reason, the structure can also contribute to the reduction in size of the downstream duct 230.

The air blowing system 200 in accordance with the preceding embodiments is preferably used when the ventilation section 112 is the filter 112*b* and/or the opening section 112*a* as in the preceding embodiments.

A whistling sound would likely be produced when the air W blown by the air blowing device 210 passes through the ventilation section 112 if the downstream duct 230 and the air blowing device 210 were arranged so that the air blowing direction of the air W was perpendicular or substantially perpendicular to the air entering face 112*b*1 of the ventilation section 112.

This potential problem is taken into account by the preceding embodiments. The downstream duct 230 and the air blowing device 210 are arranged so that the air blowing direction of the air W inclines, relative to the air entering face 112*b*1 of the ventilation section 112, in a non-distorting direction that is different from the distorting direction in which a part of the inner wall face 234*a* is distorted to form the distorted portion 235. Therefore, this structure enables the air blowing direction to incline relative to the air entering face 112*b*1 of the ventilation section 112. This structure can hence reduce the whistling sound produced when the air W blown by the air blowing device 210 passes through the ventilation section 112.

In the preceding embodiments, as well as in the second embodiment, the inner surface of the downstream duct 230 is provided with the deflecting ribs 233*d* serving as ribs that deflect the air W blown by the air blowing device 210 in an intersecting direction that is a non-distorting direction different from the distorting direction in which a part of the inner wall face 234*a* is distorted to form the distorted portion 235 and that intersects the air blowing direction of the air W. In this structure, the deflecting ribs 233*d* can deflect the air W blown by the air blowing device 210 so that the air W can flow in the intersecting direction. Thus, the deflecting ribs 233*d* can further change the flow of the air W in order to further alter the angle at which the air W blown by the air blowing device 210 strikes the ventilation section 112. The structure can hence further reduce the whistling sound produced when the air W blown by the air blowing device 210 passes through the ventilation section 112.

Preceding Embodiments (Surface Area Reducing Portion)

As described earlier, in the air blowing system 200 in accordance with the preceding embodiments, when the air W blown by the air blowing device 210 is to be vented out of the image forming apparatus 100, the air blowing device 210 is driven. The air blowing device 210 then sucks in the air W from a target member (in this example, the charging units 5*a* to 5*d* in the photosensitive body units 10*a* to 10*d*) and guides the sucked air W through the downstream duct 230 serving as the duct in accordance with the preceding embodiments, to vent the air W via the ventilation section 112 of the image forming apparatus 100 to the outside. Specifically, the air W sucked in through the air outlet ports 12*a* to 12*d* of the charging units 5*a* to 5*d* and the air inlet ports 221*a* to 221*d* of the upstream duct 220 is merged in the upstream duct 220, guided through the air outlet port 222 of the upstream duct 220 and the inlet port 213*a* and the ejection port 213*b* of the air blowing device 210, passed through the duct portion 232 and further through the filter 112*b* and the opening section 112*a*, which constitute the ventilation section 112, and vented to the outside.

In this venting, conventional technology causes the duct to bend periodically (vibrate) when the air blown by the air blowing device passes through the duct. Because of the periodical bending (vibration), the duct resonates, producing a resonating sound.

This problem is addressed by the preceding embodiments. The downstream duct 230 has a surface (outer surface 230*a* or inner surface 230*b*) on at least a part of which the surface area reducing portion 236 is provided for reducing the surface area of a continuous face. This structure can reduce the surface area of at least a part of the continuous face on the surface (230*a*, 230*b*) of the downstream duct 230. That can in turn reduce the periodical bending of the downstream duct 230 that occurs when the air W blown by the air blowing device 210 passes through the downstream duct 230. The structure can hence efficiently prevent the vibration of the downstream duct 230 and the resonance of the downstream duct 230 that could be caused by the vibration. Therefore, the structure reduces the resonating sound produced by the resonance caused by the periodical bending (vibration) of the downstream duct 230 when the air W blown by the air blowing device 210 passes through the downstream duct 230.

When the downstream duct 230 includes the intersecting duct portion 2351 in the direction that intersects the air blowing direction of the air W in the downstream duct 230 as in the preceding embodiments, the intersecting duct portion 2351 would likely bend periodically because the intersecting duct portion 2351 is in the direction that intersects the air blowing direction of the air W. Thus, the intersecting duct portion 2351 would likely to vibrate and resonate, which in turn could render a resonating sound more likely to be produced due to the vibration of the downstream duct 230.

This potential problem is taken into account by the preceding embodiments. The surface area reducing portion 236 is provided at least on the intersecting duct portion 2351 on the surface (230*a*, 230*b*) of the downstream duct 230. This structure can render the intersecting duct portion 2351 of the downstream duct 230 less likely to bend periodically, thus less likely to vibrate and resonate. The structure hence can render the resonating sound less likely to be produced by the vibration of the downstream duct 230.

In the preceding embodiments, the surface area reducing portion 236 is formed in a convex shape integrally with at least a part of the surface (230*a*, 230*b*) of the downstream duct 230. This structure enables the provision of the surface area reducing portion 236 by simply forming the surface area reducing portion 236 in a convex shape integrally with at least a part of the surface (230*a*, 230*b*) of the downstream duct 230.

In the preceding embodiments, the surface area reducing portion 236 is a demarcating portion that demarcates at least a part of the surface (230*a*, 230*b*) of the downstream duct 230. This structure can reliably reduce the surface area of at least a part of the continuous face on the surface (230*a*, 230*b*) of the downstream duct 230.

In the preceding embodiments, the surface area reducing portion 236 has a latticed part. This structure, although being simple, efficiently can reduce the surface area of at least a part of the continuous face on the surface (230*a*, 230*b*) of the downstream duct 230.

As in the preceding embodiments, as well as in the fourth embodiment, the surface area reducing portion 236 may be provided on at least a part of the inner surface 230*b* of the downstream duct 230. When this is actually the case, the flow of the air W blown by the air blowing device 210 would likely be disturbed if the resonating sound produced by the bending of the downstream duct 230 is to be reduced.

This potential problem is taken into account by the preceding embodiments, except for by the fourth embodiment. The surface area reducing portion 236 is provided on at least a part of the outer surface 230*a* of the downstream duct 230. Therefore, the surface area reducing portion 236 can reduce the resonating sound produced by the bending of the downstream duct 230 without disturbing the flow of the air W blown by the air blowing device 210.

A whistling sound would likely be produced when the air W blown by the air blowing device 210 passes through the ventilation section 112 if the downstream duct 230 and the air blowing device 210 were arranged so that the air blowing direction of the air W was perpendicular or substantially perpendicular to the air entering face 112*b*1 of the ventilation section 112.

This potential problem is taken into account by the preceding embodiments. The downstream duct 230 and the air blowing device 210 are arranged so that the air blowing direction of the air W inclines relative to the air entering face 112*b*1 of the ventilation section 112. Therefore, this structure enables the air blowing direction to incline relative to the air entering face 112*b*1 of the ventilation section 112. This structure can hence reduce the whistling sound produced when the air W blown by the air blowing device 210 passes through the ventilation section 112.

In the preceding embodiments, as well as in the second embodiment, the inner surface of the downstream duct 230 is provided with the deflecting ribs 233*d* serving as ribs that deflect the air W blown by the air blowing device 210 in a deflecting direction different from the air blowing direction. In this structure, the deflecting ribs 233*d* can deflect the air W blown by the air blowing device 210 so that the air W can flow in the deflecting direction. Thus, the deflecting ribs 233*d* change the flow of the air W, enabling altering of the angle at which the air W blown by the air blowing device 210 strikes the ventilation section 112. The structure can hence further reduce the whistling sound produced when the air W blown by the air blowing device 210 passes through the ventilation section 112.

The present invention is not limited to the embodiments described above, but may be implemented in various other forms. Therefore, the embodiments are for illustrative purposes only in every respect and should not be subjected to any restrictive interpretations. The scope of the present invention is defined only by the claims and never bound by the specification. Those modifications and variations that may lead to equivalents of claimed elements are all included within the scope of the invention.

The invention claimed is:

1. An air blowing system, comprising:

an air blowing device;

a duct that guides air blown by the air blowing device; and a ventilation section disposed downstream of the duct in terms of an air blowing direction in which air is blown by the air blowing device so that the air blown by the air blowing device strikes and passes through the ventilation section, wherein the duct has an enlarged region where a cross-sectional area of a part of an air flow passage of the duct located between the air blowing device and the ventilation section is relatively enlarged relative to upstream and downstream of the blowing direction.

2. The air blowing system as set forth in claim 1, wherein the enlarged region is a concave distortion where the part of the air flow passage is distorted in a concave shape.

3. The air blowing system as set forth in claim 1, wherein:

the duct has a linear portion between the air blowing device and the ventilation section; and the enlarged region is provided in the linear portion.

4. The air blowing system as set forth in claim 1, wherein the ventilation section is a filter and/or an opening section that has an opening, formed through an exterior member of an image forming apparatus, through which air is vented out of the image forming apparatus.

5. The air blowing system as set forth in claim 1, wherein:

the ventilation section has an air entering face where the air blown by the air blowing device enters the ventilation section; and the duct and the air blowing device are arranged so that the air blowing direction inclines, relative to the air entering face of the ventilation section, in a non-enlarging direction different from an enlarging direction in which the cross-sectional area of that part of the air flow passage is enlarged to form the enlarged region.

6. The air blowing system as set forth in claim 1, wherein the duct has an inner surface on which there is provided a rib that deflects the air blown by the air blowing device in an intersecting direction that is a non-enlarging direction different from an enlarging direction in which the cross-sectional area of that part of the air flow passage is enlarged to form the enlarged region and that intersects the air blowing direction.

7. An image forming apparatus, comprising the air blowing system as set forth in claim 1.

* * * * *